US008800162B2

(12) United States Patent
Velardi et al.

(10) Patent No.: US 8,800,162 B2
(45) Date of Patent: Aug. 12, 2014

(54) METHOD AND SYSTEM FOR CONTROLLING A FREEZE DRYING PROCESS

(75) Inventors: Salvatore Velardi, Rivarolo Canavese (IT); Antonello Barresi, Collegno (IT)

(73) Assignee: Azbil Telstar Technologies, S.L. (ES)

( * ) Notice: Subject to any disclaimer, the term of this patent is extended or adjusted under 35 U.S.C. 154(b) by 966 days.

(21) Appl. No.: 12/441,752

(22) PCT Filed: Sep. 19, 2007

(86) PCT No.: PCT/EP2007/059921

§ 371 (c)(1),
(2), (4) Date: Nov. 5, 2009

(87) PCT Pub. No.: WO2008/034855

PCT Pub. Date: Mar. 27, 2008

(65) Prior Publication Data

US 2010/0107436 A1 May 6, 2010

(30) Foreign Application Priority Data

Sep. 19, 2006 (EP) ..... 06019587

(51) Int. Cl.
*F26B 5/06* (2006.01)

(52) U.S. Cl.
USPC ..... 34/284; 34/298

(58) Field of Classification Search
USPC ..... 34/284, 285, 286, 298, 301
See application file for complete search history.

(56) References Cited

U.S. PATENT DOCUMENTS

| | | | | |
|---|---|---|---|---|
| 6,163,979 | A | 12/2000 | Oetjen et al. | |
| 6,931,754 | B2 | 8/2005 | Sennhenn et al. | |
| 6,971,187 | B1 | 12/2005 | Pikal et al. | |
| 2008/0172902 | A1 * | 7/2008 | Gruber et al. | 34/286 |

FOREIGN PATENT DOCUMENTS

| | | | |
|---|---|---|---|
| DE | 1038988 | B | 9/1958 |

* cited by examiner

*Primary Examiner* — Jiping Lu
(74) *Attorney, Agent, or Firm* — Laubscher & Laubscher, P.C.

(57) ABSTRACT

A method for monitoring and/or controlling and a freeze drying process in a freeze dryer apparatus provided with a drying chamber having a temperature-controlled shelf supporting containers of a product to be dried, comprises during a primary drying phase of the freeze drying process the steps of:

isolating the drying chamber closing an isolating valve thereof and sensing and collecting pressure values inside the drying chamber for a defined pressure collecting time and a shelf temperature of the temperature-controlled shelf (Step 1);

calculating a product temperature of product and a plurality of process/product related parameters (Step 2);

calculating a new shelf temperature and a sequence of shelf temperatures up to the end of the primary drying phase, that maximizes a sublimation rate of the product maintaining the product temperature below a maximum allowable product temperature.

26 Claims, 7 Drawing Sheets

METHOD AND SYSTEM FOR CONTROLLING A FREEZE DRYING PROCESS

This application is a continuation of PCT International Application No. PCT/EP2007/059921 filed Sep. 19, 2007. PCT/EP2007/059921 claims priority to EP Application No. 06019587.2 filed Sep. 19, 2006. The entire contents of these applications are incorporated herein by reference.

The invention relates to a method and a system for controlling a freeze-drying process, in particular for optimizing and controlling a freeze-drying process for pharmaceutical products arranged in containers.

Freeze-drying, also known as lyophilization, is a dehydration process that enables removal by sublimation of water and/or solvents from a substance, such as food, a pharmaceutical or a biological product. Typically the freeze drying process is used to preserve a perishable product since the greatly reduced water content that results inhibits the action of microorganisms and enzymes that would normally spoil or degrade the product. Furthermore, the process makes the product more convenient for transport. Freeze-dried products can be easily rehydrated or reconstituted by addition of removed water and/or solvents.

A known freeze-dryer apparatus for performing a freeze-drying process usually comprises a drying chamber and a condenser chamber interconnected by a duct that is provided with a valve that allows isolating the drying chamber when required during the process.

The drying chamber comprises a plurality of temperature-controlled shelves arranged for receiving containers of product to be dried. The condenser chamber includes condenser plates or coils having surfaces maintained at very low temperature, i.e. −50° C., by means of a refrigerant or freezing device. The condenser chamber is also connected to one or more vacuum pumps sucking air so as to achieve high vacuum value inside both chambers.

Freeze drying process typically comprises three phases: a freezing phase, a primary drying phase and a secondary drying phase.

During the freezing phase the shelf temperature is reduced up to typically −30/−40° C. in order to convert into ice most of the water and/or solvents contained in the product.

In the primary drying phase the shelf temperature is increased up to 30-40° C. while the pressure inside the drying chamber is lowered below 1-5 mbar so as to allow the frozen water and/or solvents in the product to sublime directly from solid phase to gas phase. The application of high vacuum makes possible the water sublimation at low temperatures.

The heat is transferred from the shelf to a product surface and from the latter to a sublimating or ice front interface that is a boundary or interface between frozen portion and dried portion of product. The ice front moves inwards into the product, from the top to the bottom of container, as the primary drying phase proceeds. The external dried portion ("dried cake") of product acts as insulator for the inner frozen portion and also as a variable resistance for vapours to escape, thus the drying process may require different amounts of heat for sublimation.

The sublimation of frozen water and/or solvents creates dried regions with porous structure, comprising a network of pores and gaps for the vapour escape.

The vapour is removed from the drying chamber by means of condenser plates or coils of condenser chamber wherein the vapour can be re-solidified or frozen.

Secondary drying phase is provided for removing by desorption the amount of unfrozen water and/or solvents that cannot be removed by sublimation. During this phase the shelf temperature is further increased up to a maximum of 30-60° C. to heat the product, while the pressure inside the drying chamber is set typically below 0.1 mbar.

At the end of secondary drying phase the product is sufficiently dried with residual moisture content typically of 1-3%.

The freeze-dried product can be sealed in containers to prevent the reabsorption of moisture. In this way the product may be stored at room temperature without refrigeration, and be protected against spoilage for many years.

Since freeze-drying is a low temperature process in which the temperature of product does not exceed typically 30° C. during the three phases, it causes less damage or degradation to the product than other dehydration processes using higher temperatures. Freeze drying doesn't usually cause shrinkage or toughening of the product being dried. Freeze-dried products can be rehydrated much more quickly and easily because the porous structure created during the sublimation of vapour.

In the pharmaceutical field, freeze-drying process is widely used in the production of pharmaceuticals, mainly for parenteral and oral administration, also because freeze-drying process further guarantees sterility of the product.

Freeze drying is a process requiring careful and precise optimization and control of the physical parameters, i.e. shelf temperature, product temperature, pressure, moisture content, inside the drying chamber during the three phases, and particularly during the primary drying phase, which is usually the longest phase of the process. For example, a product temperature too low can increase the time required for drying the product or even cause an incomplete or inefficient drying. By the other side, a product temperature too high that speeds up the drying process may cause damage or degradation of the product.

There are known freeze drying control systems in which no physical parameters of the product to be dried are measured during the freeze drying process, the control system merely repeating an empirical set of defined conditions which have been determined after many experiments and tests. Furthermore the operating conditions so selected not necessarily are optimum or even near optimum. Furthermore, said method does not provide a feedback control of the process, which can result inefficient and provide a low quality product.

To overcome these disadvantages, there are known freeze drying control systems in which the product temperature is monitored during the freeze drying process by means of temperature sensors, typically thermocouples, which are arranged in contact with the product. In particular, thermocouples are placed inside a certain number of containers, which are assumed to be representative of the entire batch of production, usually consisting of several thousand of containers.

This method has however several drawbacks.

During the freezing phase each thermocouple acts as a site for heterogeneous nucleation of the ice and therefore influences the freezing process of the product. As a result, the ice structure and consequently the drying behaviour of the product are different between monitored containers and non-monitored containers.

Furthermore, thermocouples must be manually inserted into the containers, this procedure requiring time and labour. Even more, thermocouples cannot be used in sterile or aseptic process and when the lyophilizer is automatically loaded and unloaded.

Another approach, that estimates the average interface temperature of the whole batch of production, is the Manometric Temperature Measurement (MTM), proposed since 1958 and applied since 1968. Said method comprises the following steps: closing the duct valve for isolating the drying chamber, measuring the pressure rise due to sublimation of product, approaching the equilibrium value and obtaining information regarding the product.

Early methods just obtained a rough estimation of product interface temperature. U.S. Pat. No. 6,971,187 and U.S. Pat. No. 6,163,979 proposed control methods that implement the MTM method for a more precise estimation of the product interface temperature (or better, and estimation of the vapour pressure over ice).

In particular U.S. Pat. No. 6,163,979 propose a method based on differentiation of the first seconds of the pressure rise curve, that allows to estimate the interface temperature without adopting a model, applicable only if the valve has a very quick opening without delay. U.S. Pat. No. 6,971,187 adopted a model, previously disclosed in literature, that allows the estimation of the interface temperature and of the product resistance. Said parameters are determined by MTM model with a regression analysis, by fitting the measured pressure rise response to the pressure values obtained through to a simplified model built considering the addition of the contribution of the main different mechanisms involved.

Various approximations are made in developing the model, which can be potential source of errors: the thermal gradient across the frozen layer is assumed constant and the frozen product is assumed to behave like a slab thermally insulated at both faces, while the interface is in contact with the porous matrix and the other end with the container. The temperature gradients in the container, the residual height of frozen material and the heat transfer coefficient, are assumed, or calculated with simple relationship making strong simplifying assumptions.

Furthermore, methods including MTM model do not give good results up to the end-point of the primary drying step, but generally only for about two-thirds of its duration. Thus these control methods are not able to maximise the product temperature and, at the same time, guarantee the integrity of the product throughout all the main drying.

Known control methods implementing MTM model for controlling freeze-dryer defines control actions step by step after each MTM test. Said methods, in fact, do not use any model to predict the product temperature evolution, and thus are not able to consider what will happen in the future and to optimise anything, but they set a new shelf temperature taking care to avoid over-temperature in the product and trying to approach the best one. But actually said control methods perform this by trials, as disclosed in U.S. Pat. No. 6,971,187, even if in automatic way, with over-cautions due to inaccuracies. Furthermore, the set point approaches the optimal value only after several steps, obtaining as a result a cycle that is generally far from the close-to-optimal one.

In practice, to define a shelf temperature, the method implementing MTM model starts establishing shelf temperature as the product required temperature. This is an extremely safe action. After the first MTM test is done and the resulting product temperature is evaluated, the shelf temperature is raised by a certain step in order to see what the product temperature will be. The method of U.S. Pat. No. 6,971,187 actually calculates a new shelf temperature that guarantees the same sublimation rate with the product at the target temperature. After another subsequent MTM is done, and the evaluated product temperature is still found far enough of the target one, the shelf temperature is raised again in the same way. This makes that finding the right shelf temperature can be very long and it cannot be assured that it will be found within the duration of a single test run.

An object of the invention is to improve the methods and systems for controlling a freeze-drying process, particularly for optimizing and controlling a freeze-drying process of pharmaceuticals arranged in containers.

A further object is to provide a method and a system for finding in an automated way the optimal process conditions for the main drying phase of a freeze-drying cycle for a product, minimizing the drying time using an optimal heating shelf temperature control strategy arranged for continuously adjusting the temperature of the temperature-controlled shelves through the freeze-drying process.

Another object is to provide a method and a system for calculating in real-time a sequence of temperature values for the temperature-controlled shelves of drying chamber during the primary drying phase, so as to perform the best cycle considering the process constraints set by the user, while maintaining the product at a safe temperature level.

A still further object is to provide a method and a system that is non-invasive and not-perturbing the freeze-drying process and suitable for being used in sterile and/or aseptic processes and when automatic loading/unloading of the containers is used.

Another object is to provide a method and a system for estimating a process state of the product during a primary drying phase by calculating a plurality of product/process variables.

Further object is to provide a method and a system for calculating in real-time a sequence of temperature values for the temperature-controlled shelves of drying chamber during the primary drying phase, so as to perform a freeze-drying process minimizing a drying time while maintaining the product at a safe temperature level.

According to a first aspect of the invention, a method is provided as defined in claim 1.

The method provides calculating said product temperature and said plurality of process/product related parameters by means of an estimator algorithm (Dynamic Parameters Estimation DPE), which implements an unsteady state model for mass transfer in said drying chamber and for heat transfer in the product and comprises a plurality of equations.

Thanks to the estimator algorithm DPE it is thus possible to calculate a product temperature at a sublimation interface of product, a mass transfer resistance in a dried portion of product (or equivalently an effective diffusivity coefficient), a product temperature at an axial coordinate and at a time during said pressure collecting time; a heat transfer coefficient between said temperature-controlled shelf and said container, a thickness of the frozen portion of product, a mass sublimation flow in the drying chamber, and a remaining primary drying time.

Said parameters and values estimated by the estimator algorithm DPE can be used by a control algorithm for calculating a time varying product temperature and an optimal sequence of shelf temperatures.

Owing to this aspect of the invention it is also possible to calculate in real-time required shelf temperature values of the temperature-controlled shelves during the primary drying phase of a freeze-drying process. In particular, the three-steps procedure of the method can be periodically repeated all along the primary drying phase. Thus it is possible to update the calculation of the optimal time sequence of shelf temperature values, correcting for inaccuracy of the model or the estimation, and taking care of eventual disturbances, for accurately controlling a heat flux generated by said temperature-controlled shelves in order to minimize the duration of drying phase and at the same time to maintain the product at a safe temperature level.

Furthermore, thanks to the method of the invention it is possible to take into account actual dynamics of the freeze dryer in heating or cooling the system and, since the state estimation is given by estimator algorithm DPE, it is also possible to consider the temperature increase that occurs when a pressure rise test has been performed.

The controller above described can eventually also work receiving the same inputs from an estimation tool different from DPE, or can receive inputs from different sensors, depending on the rules given by the user.

Since the pressure values are measured by pressure sensors placed inside the drying chamber but not in contact with the product, the method of the invention is non-invasive and not-perturbing the freeze-drying process, and particularly the product freezing, and furthermore it is suitable for being used in sterile and/or aseptic processes.

According to a second aspect of the invention, a method is provided as defined in claim 22.

Owing to this aspect of the invention it is possible to calculate in real-time required shelf temperature values of the temperature-controlled shelves during the primary drying phase of a freeze-drying process. The procedure of the method can be periodically repeated all along the primary drying phase so as to update the calculation of the optimal time sequence of shelf temperature values, correcting for inaccuracy of the model or the estimation, and taking care of eventual disturbances, for accurately controlling a heat flux generated by said temperature-controlled shelves in order to minimize the duration of drying phase and at the same time to maintain the product at a safe temperature level. The method comprises a control algorithm, based on a numerical code, which implements a non stationary mathematical model of containers and of freeze dryer apparatus and an optimization algorithm which uses the input values, in particular thermo-physical parameters of product and/or of process and/or defined by an user, for calculating a time varying product temperature and an optimal sequence of shelf temperatures that maximises the product temperature warranting that a maximum allowable product temperature will be never overcome. The control algorithm can receive said input values from an estimator tool or from a sensor, according to the rules given by the user.

The invention can be better understood and carried into effect with reference to the enclosed drawings, that show an embodiment of the invention by way of non limitative example, in which.

Figure 1:
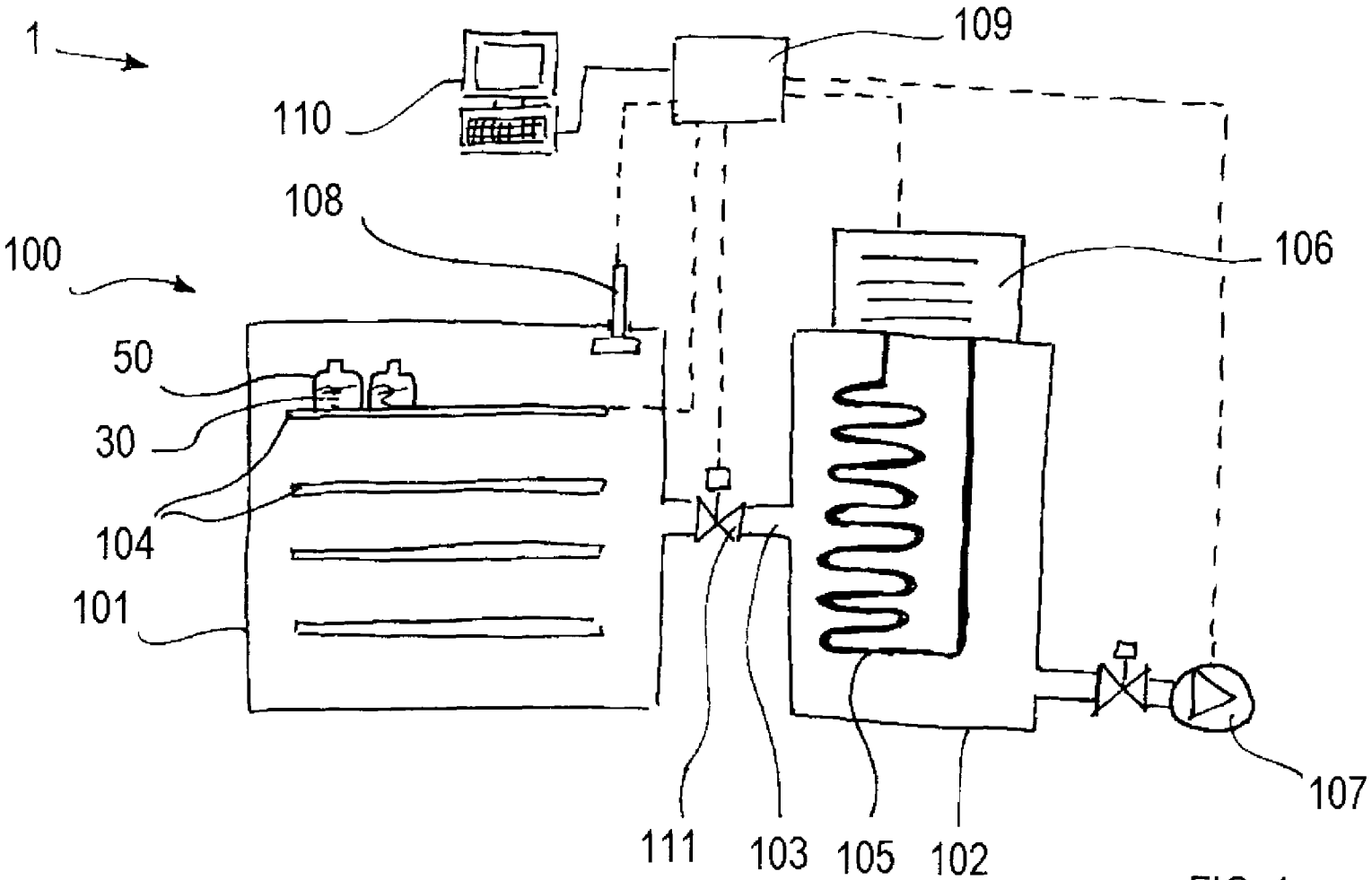
FIG. 1 is a schematic view of a the system of the invention for controlling a freeze drying process, associated to a freeze-dryer apparatus.

With reference to FIG. 1, numeral 1 indicates a control system 1 associated to a freeze-dryer apparatus 100 comprising a drying chamber 101 and a condenser chamber 102 interconnected by a duct 103 provided with a valve 111. The drying chamber 101 comprises a plurality of temperature-controlled shelves 104 arranged for receiving containers 50, i.e. vials or bottles, containing a product 30 to be dried. The condenser chamber 102 includes a condenser 105, such as plates or coils, connected to a refrigerant device 106. The external surfaces of the condenser 105 are maintained at very low temperature (i.e. −50° C.) in order to condensate the water vapour generated during the sublimation (drying phases) of product 30.

The condenser chamber 102 is connected to a vacuum pump 107 arranged to remove air and to create high vacuum value—i.e. a very low absolute pressure—inside the condenser chamber 102 and the drying chamber 101.

The control system 1 includes a pressure sensor 108 placed inside the drying chamber 101 for sensing an inner pressure therein during the freeze-drying process.

The control system further comprise a control unit 109 arranged for controlling the operation of the freeze-dryer apparatus 100 during the freeze-drying process, i.e. for controlling the temperature-controlled shelves 104, the vacuum pump 107, the refrigerant device 106, the valve 111. The control unit 109 is also connected to the pressure sensor 108 for receiving signals related to pressure values inside the drying chamber 101.

The control system 1 further comprises a calculating unit 110, for example a computer, connected to the control unit 109 and provided with an user interface for entering operation parameters and data of freeze-drying process and a storage unit for storing said parameters and data and said signals related to pressure values. The calculating unit 110 executes a program that implements the method of the invention.

Said method allows calculating in real-time an optimal sequence of temperature shelf values for the temperature-controlled shelves 104 during the primary drying phase so as to realize a freeze-drying process minimizing a drying time while maintaining the product 30 at a safe temperature level. The method comprises a non-invasive, on-line adaptive procedure which combines pressure values collected by the pressure sensor 108 at different times during the primary drying phase with a dynamic estimator algorithm DPE (Dynamic Parameter Estimation), that provides physical parameters of product and process (mainly product temperature T (at the interface and at the bottom), mass transfer resistance $R_p$, heat transfer coefficient between shelf and product, residual frozen layer thickness).

Said parameters can be outputs to be used by an operator.

Then a controller implementing an advanced predictive control algorithm uses the parameters calculated by DPE estimator for calculating operating parameters (i.e. temperature $T_{shelf}$ of temperature-controlled shelves 104) required for optimizing and controlling the freeze drying process.

In the following description, the equations of DPE estimator and controller will be illustrated in detail.

Figure 2:
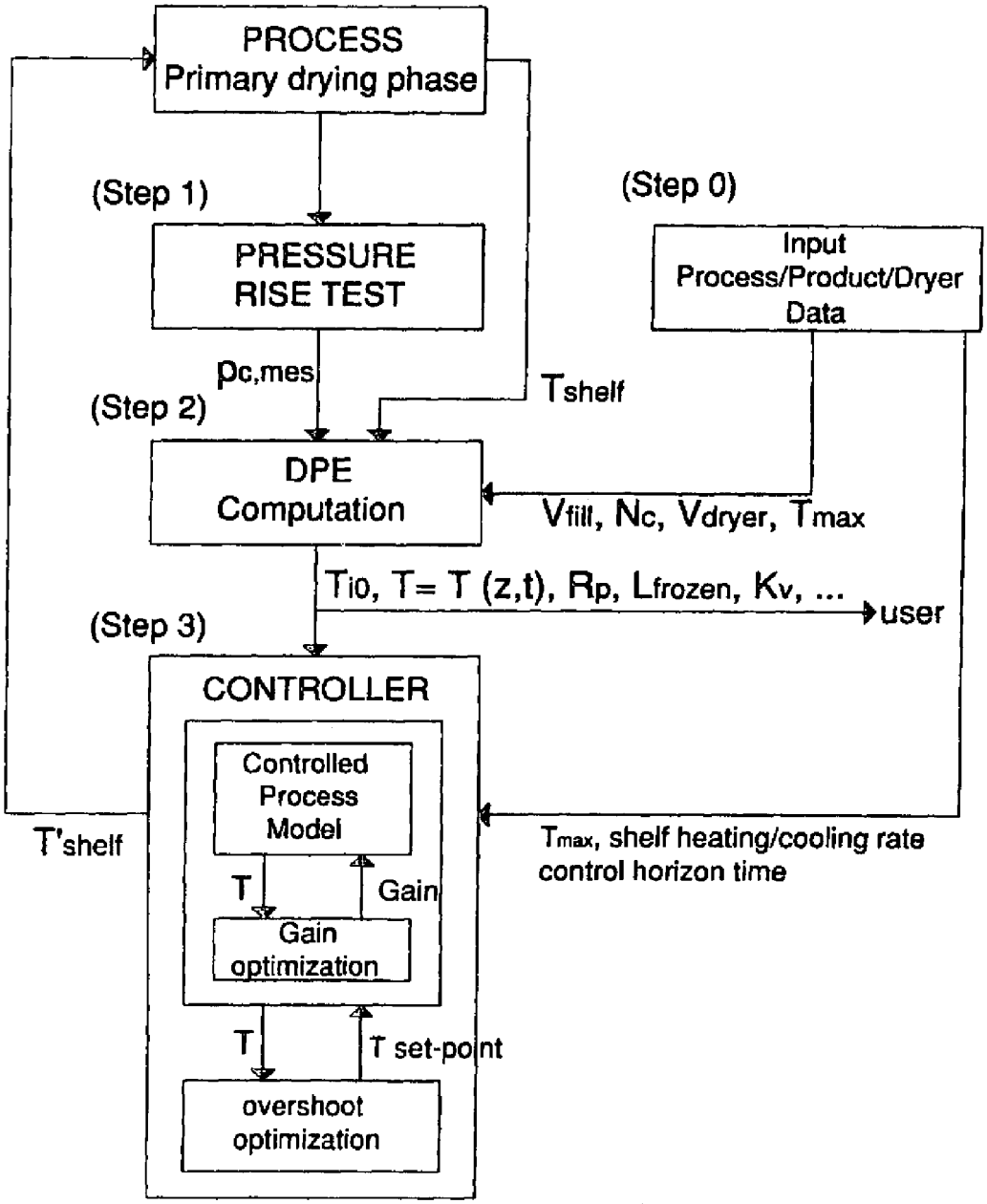
FIG. 2 is a flowchart schematically showing the method of the invention for controlling a freeze drying process.

The method basically comprises an operating cycle, which include four different steps, as illustrated in FIG. 2.

At the beginning of the cycle (Step 0) data related to characteristics of the loaded batch of product 30 have to be entered by a user into the calculating unit 110.

Then a three steps procedure is performed automatically by the control system 1 at different times during primary drying phase in order to determine a sequence of shelf temperature set-points:

Step 1 (pressure rise test): closing valve 111 and collecting pressure values data for a defined pressure collecting time $t_f$, i.e. few seconds, and a shelf temperature $T_{shelf}$;

Step 2: calculating a product temperature profile T and other process/product related parameters by means of DPE estimator;

Step 3: calculating a new shelf temperature value $T'_{shelf}$, using a model predictive algorithm, which employs the product temperature T and process and product parameters calculated in step 2.

The step 0 provides, after loading the product container batch, to enter data into the calculating unit 110 for adjusting a plurality of parameters related to characteristics of freeze drying process, freeze dryer apparatus 100, product 30, containers 50 and control options. In particular, these parameters include, as concern the DPE computations: liquid volume filling each container $V_{fill}$, number of loaded containers $N_c$, volume of drying chamber $V_{dryer}$, thermo-physical characteristics of solvent present in product (if different from water).

As concerns the control options, the parameters include the maximum allowable product temperature $T_{MAX}$, the control logic selected, horizon and control time.

These data must be inserted only once, since they don't change during the process.

The data concerning the actual cooling and heating rate of the apparatus are also entered to the controller. These data are generally identified by a standard qualification procedure and stored in the memory of the system, but can be changed by the operator or updated by the controller self-adaptively by comparison with the actual performances. In particular, the value of the cooling rate is obtained comparing the final cooling rate of the equipment during the freezing stage, or eventually the cooling rate during the drying stage, measured for example by a thermocouple on the shelf, with the expected one. The heating rate is checked at the beginning of the drying stage, when the shelf temperature is raised for the first time, again by comparison of the actual temperature, measured for example by a thermocouple, with the expected one. The procedure will be illustrated in detail.

After the freezing phase of product, the process switches to primary drying phase and the control system 1 starts step 1.

In the step 1, control unit 109 closes the valve 111 while calculating unit 110 automatically starts performing a sequence of pressure rise tests at predefined time intervals, for example every 30 minutes. In particular, calculating unit 110 collects from the pressure sensor 108 data signals related to pressure values rising inside the drying chamber 101. Collecting data for 15 seconds at a sampling rate of 10 Hz is normally sufficient. Pressure collecting time $t_f$ may range from few seconds, i.e. 5 seconds, to a few minutes depending on the process conditions and may be optimised, while sampling rate may range from 5 to 20 Hz.

When pressure data have been collected, the calculating unit 110 processes said data starting step 2.

In particular, the pressure rise data are processed by the Dynamic Parameters Estimation DPE, which implements a rigorous unsteady state model for mass transfer in the drying chamber 101 and for heat transfer in the product 30, given by a set of partial differential equations describing:

- conduction and accumulation of heat in a frozen layer of the product 30;
- mass accumulation in the drying chamber during the pressure rise test;
- time evolution of product thickness.

The DPE algorithm is integrated along time in the internal loop of a curvilinear regression analysis, where the parameters to be estimated are the product temperature of the ice front $T_{i0}$ at the beginning of the test and the mass transfer resistance in the dried cake $R_p$. The cost function to minimise in a least square sense is the difference between the values of the chamber pressure simulated through the mathematical model and the actual values collected during the pressure rise.

The main results made available by DPE estimator when computation has been performed are: product temperature of the ice front ($T_{i0}$) at the beginning of the test (determined as solution of a non-linear optimization problem);

- mass transfer resistance in the dried cake ($R_p$) (determined as solution of a non-linear optimization problem);
- temperature profile of the product 30 at any axial position ($T=T(z,t)$) at each time during the pressure rise test (determined from the equations describing the DPE system);
- heat transfer coefficient between the heating shelf and the container ($K_v$) (determined from the DPE equations);
- actual thickness of the frozen portion of product 30 ($L_{frozen}$) (determined from the DPE equations);
- mass flow in the drying chamber 101;
- remaining primary drying time.

The equations of DPE algorithm and the procedure for determining the solution of the non-linear optimization problem will be explained in detail in the following description.

During the pressure rise test (step 1) the ice temperature increases (even 2-3° C. are possible). The approach of the DPE estimator allows following dynamics of the temperature all along the duration of the test and calculating the maximum temperature increase. This value must be evaluated because, even during the pressure rise, the temperature should not overcome the maximum allowable value set by the user in step 0.

In the step 3 the calculating unit 110 provides the calculation of a new shelf temperature value $T'_{shelf}$, according to the product temperature profile calculated in step 2. The control algorithm of controller, which includes a transient mathematical model for the primary drying, starting from the results obtained in step 2, is able to predict the time evolution of the product temperature T and the time evolution of ice front position until the end of the primary drying phase.

The controller is used to maintain the product temperature T below the maximum allowable value $T_{max}$. In practice, based on the predictions of the controlled model, a sequence of shelf temperature values is generated which maximizes the heat input (i.e. minimizes the drying time) thus driving the system towards a target temperature value chosen by the user, for example 1-2° C. below the maximum allowable product temperature $T_{max}$.

When a new shelf temperature value has been computed, only correction actions till a subsequent pressure rise test are taken by the control system 1 and sent to freeze-dryer apparatus 100. In fact, when the successive pressure rise test is performed, step 2 and 3 are repeated and a new sequence of shelf temperature values is determined. In this way, an adaptive strategy is realized which is able to compensate for intrinsic uncertainties of DPE estimator and of controller minimizing the disturbances.

The controller takes also into account the dynamics of the response of the freeze-drier apparatus to change of the temperature values because it is calibrated considering the maximum heating and cooling velocity of shelf 104.

This allows to predict potentially damaging temperature overshoots and to anticipate the control action accordingly. Furthermore, the temperature value sequence is generated in such a way that the target product temperature is achieved without overcoming the maximum allowable value even during the pressure rise tests. This is possible because the controller receives as input the maximum temperature increases measured by the DPE estimator.

All this operations are performed by the controller without intervention of user, even for the selection of the controller gain. In fact, the optimal proportional gain of the controller is automatically selected/modified by the system 1 after each pressure rise test. The selection is done according to the criterium of minimization of the integral square error (ISE) between the target temperature and the predicted product temperature.

The DPE estimator takes into account the different dynamics of the temperature at the interface or sublimating front and at a container bottom. In particular, the DPE estimator comprises an unsteady state model for heat transfer in a frozen layer of product 30, given by a partial differential equation describing conduction and accumulation in the frozen layer during the pressure rise test ($t>t_0$).

The initial condition (I.C.) is written considering the system in pseudo-stationary conditions during primary drying phase, before starting the pressure rise test. Considering initial pseudo-stationary condition corresponds to assume a linear temperature profile in the frozen layer at $t=t_0$. Concerning boundary conditions (B.C.), a heat flux at the bottom of the container is given by the energy coming from the temperature-controlled shelf 104, while at the interface it assumed to be equal to the sublimation flux. In this approach, either radiations from the container side and conduction in the container glass are neglected. Thus, heat transfer in the frozen layer is described by the following equations of DPE estimator:

$$\frac{\partial T}{\partial t} = \frac{k_{frozen}}{\varrho_{frozen} c_{P,frozen}} \frac{\partial^2 T}{\partial z^2} \quad \text{for } t > t_0,\ 0 < z < L_{frozen} \tag{eq. 1}$$

$$T|_{t=0} = T_{i0} + \frac{z}{k_{frozen}} \frac{\Delta H_s}{R_P}(p(T_{i0}) - p_{w0}) \quad I.C.:\ t = 0,\ 0 < z < L_{frozen} \tag{eq. 2}$$

$$k_{frozen} \frac{\partial T}{\partial z}\bigg|_{z=0} = \frac{\Delta H_s}{R_P}(p(T_i) - p_w) \quad B.C.1:\ t \geq 0,\ z = 0 \tag{eq. 3}$$

$$k_{frozen} \frac{\partial T}{\partial z}\bigg|_{z=L} = K_v(T_{shelf} - T_B) \quad B.C.2:\ t \geq 0,\ z = L_{frozen} \tag{eq. 4}$$

where $T = T(z, t)$, $T_i = T(t)|_{z=0}$, $T_B = T(t)|_{z=L}$, $T_{i0} = T|_{z=0,t=0}$.

The parameters of equations are the followings:

| | |
|---|---|
| A | internal cross surface of the container [$m^2$] |
| $c_P$ | specific heat at constant pressure [J $kg^{-1}$ $K^{-1}$] |
| $F_{leak}$ | leakage rate [Pa $s^{-1}$] |
| k | thermal conductivity [J m $s^{-1}$ K] |
| $K_v$ | overall heat transfer coefficient [J $m^{-2}$ $s^{-1}$ K] |
| L | total product thickness [m] |
| $L_{frozen}$ | frozen layer thickness [m] |
| M | molecular weight [kmol $kg^{-1}$] |
| $N_v$ | number of containers |
| p | pressure [Pa] |
| R | ideal gas Constant [J $kmol^{-1}$ K] |
| $R_p$ | mass transfer resistance in the dried layer [$m^{-1}$ s] |
| T | Temperature [K] |
| t | time [s] |
| $T_B$ | frozen layer temperature at z = L [K] |
| V | Volume [$m^3$] |
| z | axial coordinate [m] |

-continued

| | |
|---|---|
| ρ | mass density [kg $m^{-3}$] |
| $\Delta H_s$ | enthalpy of sublimation [J $kg^{-1}$] |
| Subscripts and superscripts: | |
| 0 | value at z = 0 |
| frozen | frozen layer |
| c | chamber |
| i | interface |
| in | inert gas |
| mes | measured |
| shelf | heating shelf |
| w | water vapour |

T=T(z,t) is the product temperature at an axial position (z) and at time (t) during said pressure collecting time ($t_f$).

The heat fluxes at position z=0, corresponding to the sublimating front, and at $z=L_{frozen}$ are generally not equal during the algorithm DPE run, because of accumulation in the frozen layer, except at the beginning because of the pseudo-stationary behavior. Thanks to this assumption, the expression for the heat transfer coefficient, assumed constant during the pressure rise test, can be derived by equating equation (eq. 3) and equation (eq. 4) at $t=t_0$.

The expression for the temperature at the bottom of the container $T_B$ at the beginning of the run is obtained by the equation (eq. 2) for $z=L_{frozen}$. These expressions give and $T_{B0}$ as functions of $T_{i0}$ and $R_P$. Thus:

$$K_v = \left[\frac{T_{shelf} - T_{i0}}{\frac{\Delta H_s}{R_P}(p(T_{i0}) - p_{w0})} + \frac{L_{frozen}}{k_{frozen}}\right]^{-1} \tag{eq. 5}$$

$$T_{B0} = T_{i0} + \frac{L_{frozen}}{k_{frozen}} \frac{\Delta H_s}{R_P}(p(T_{i0}) - p_{w0}) \tag{eq. 6}$$

where $T_{shelf}$ is a measured input of the process. Previous equations are completed with the equations providing the dynamics of the water vapor pressure rise in the drying chamber 101, which consists in the material balance in the chamber for the vapor, where the amount of water produced by desorption from the dried layer is neglected. Finally the total pressure is calculated by assuming constant leakage in the drying chamber 101:

$$\frac{dp_w}{dt} = \frac{N_v A}{V_c} \frac{RT_i}{M_w} \frac{1}{R_P}(p_i(T_i) - p_w) \quad \text{for } t > 0 \tag{eq. 7}$$

$$p_c = p_w + p_{in} = p_w + F_{leak} \cdot t + p_{in0} \quad \text{for } t \geq 0 \tag{eq. 8}$$

$$p_w|_{t=0} = p_{c0} - p_{in0} \quad I.C.:\ t = 0 \tag{eq. 9}$$

If no data are available for the inert pressure, an initial value of zero is used.

The actual thickness of the frozen layer is needed to perform calculation. In the DPE algorithm the expression for $L_{frozen}$ giving the mass of frozen product still present in the container is solved contemporaneously to the dynamics equations of the model. The two equations (eq. 10) or (eq. 10B), that simply integrate the energy or the sublimation flux in the time interval between two subsequent pressure rise tests to estimate the actual value of the frozen layer thickness, can be used alternatively:

$$\varrho_{frozen} A L_{frozen,n} + \varrho_{dried} A(L - L_{frozen,n}) = \varrho_{frozen} A L_{frozen,n-1} - \frac{K_v A}{\Delta H_s}(T_{shelf} - T_{B0}) \times \Delta t_{n-1} \quad \text{(eq. 10)}$$

where $L_{frozen,n-1}$ is the frozen layer thickness calculated in the previous pressure rise test and $\Delta t_{-1}$ is total time passed between the actual and the preceding run. The initial thickness of the product is an input of the process.

$$L_{frozen,n} = L_{frozen,n-1} - \frac{1}{\varrho_{frozen} - \varrho_{dried}}\left[\frac{K_v}{\Delta H_s}(T_{shelf} - T_{B0}) + N_{w,n-1}\right] \cdot \frac{\Delta t_{n-1}}{2} \quad \text{(eq. 10B)}$$

where $N_{w,n-1}$ is the mass flux evaluated in the previous DPE test. The above equations correspond to apply the rectangular or the trapezoidal integration rule, respectively.

The spatial domain of the frozen layer has been discretised in order to transform the differential equation (eq. 1) in a system of ODEs; the orthogonal collocation method has been employed to obtain the values of T(z,t) in the nodes of the spatial grid.

At each pressure rise test the discretised system of equations (eq. 1) to (eq. 10) is integrated in time in the internal loop of a curvilinear regression analysis, where the parameter to be estimated are the initial interface temperature $T_{i0}$ and the mass transfer resistance $R_P$.

The cost function to minimize in a least square sense is the difference between the simulated values of the drying chamber pressure and the actual values measured during the pressure rise. The Levenberg-Marquardt method has been used in order to perform the minimization of the cost function.

Figure 3:
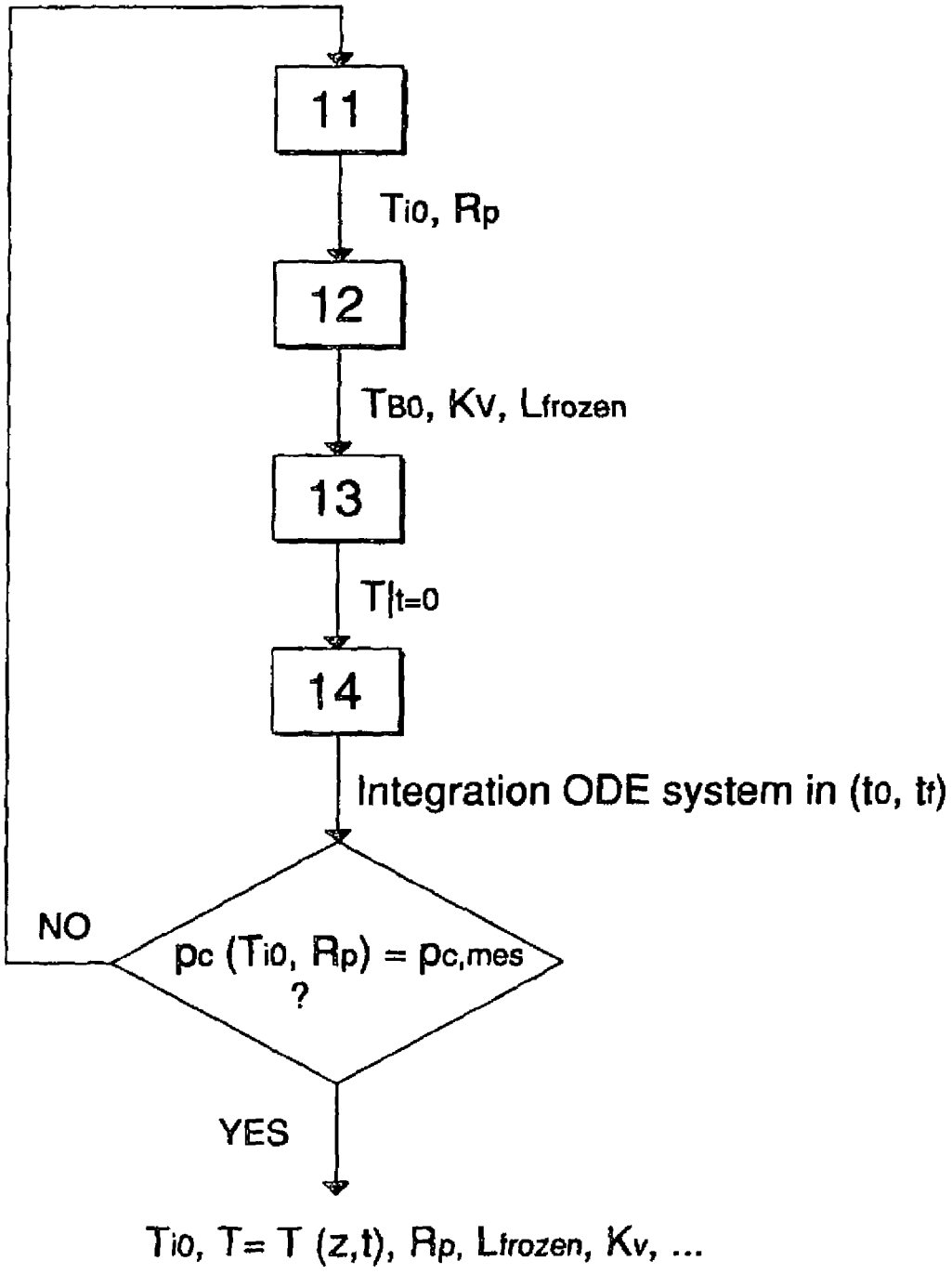
FIG. 3 is a flowchart showing an optimization procedure of a dynamic estimator algorithm DPE implemented in the control method of the invention.

With reference to FIG. 3, the steps of the optimization procedure for solving the non-linear optimization problem are the following:

- initial guess of $T_{i0}$, $R_P$ (step 11);
- determination of $T_{B0}$, $K_v$, $L_{frozen}$ from equations (eq. 6), (eq. 5), (eq. 10) or (eq. 10B) (step 12);
- determination of the initial temperature profile in the frozen mass, from equation (eq. 2) (step 13);
- integration of the discretised ODE system in the interval $(t_0,t_f)$, where $t_f-t_0$ is the duration of the algorithm DPE run (step 14);
- repetition of step 11 to 14 and determination of the couple of $T_{i0}$, $R_P$ values that best fits the simulated drying chamber pressure, $p_c(T_{i0},R_P)$, to the measured data, $p_{c,mes}$, in order to solve the non-linear least square problem, that is to minimize the integral square error (ISE) between the said pressure values:

$$\min_{T_{i0},R_p} \frac{1}{2}\|p_c(T_{i0}, R_P) - p_{c,mes}\|_2^2 = \frac{1}{2}\sum_j \left(p_c(T_{i0}, R_P)_j - (p_{c,mes})_j\right)^2 \quad \text{(eq. 11)}$$

The values related to the new state of the system, i.e. temperature profile $T_{i0}$ in the product, frozen layer thickness $L_{frozen}$, mass transfer resistance in the dried cake $R_P$, shelf to product heat transfer resistance, temperature increase during the pressure rise test $\Delta T_{DPE}$, etc., so calculated can be used by the controller to calculate a new shelf temperature value $T'_{shelf}$.

The DPE also pass to user an estimation of the residual drying time, extrapolating the value of the residual frozen layer thickness, that can be used by the controller for as a first estimation of the prediction horizon required. The latter is the time interval (in minutes), corresponding to remaining time for primary drying to be completed, throughout the program estimates the time varying product temperature and computes a suitable sequence of set-point shelf temperatures.

The value of mass flow in the drying chamber 101 can be used by the operator, and/or used by the system for confirming by comparison the end of primary drying.

Figure 4:
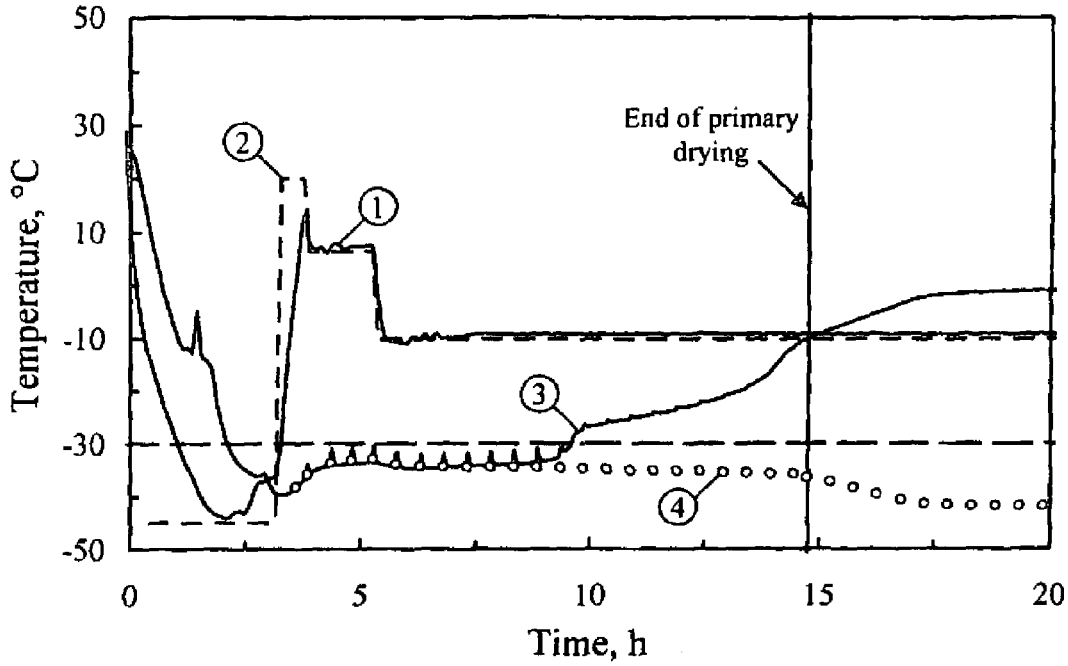
FIG. 4 is a graph showing an optimal freeze-drying cycle obtained using the control system of the invention for setting an optimal shelf temperature for the primary drying stage.

DPE is based on an unsteady state model and, therefore, it is able to evaluate also the temperature increase connected to the pressure rise test. As a consequence, the controller can directly use this information in order to calculate a proper shelf temperature and maintains product temperature as closed as possible to its bound, but taking also into account that at regular time a pressure rise test will be done to update the system state and, thus, a product temperature increase will occurs. In fact, as shown in FIG. 4, the product temperature rise due to DPE test is always lower than the maximum product temperature allowable.

This kind of information is not taken into account in the known methods implementing the MTM model wherein actions must be more precautionary in order to avoid that these phenomena may impair the product integrity.

In addition, in MTM model, the product temperature at the bottom is estimated in an approximate way, considering the initial instead of the actual ice thickness, and also the heat resistance of the frozen layer is approximate. This results in an uncertainty in the temperature estimation, and consequently in a larger safety margin; in DPE the temperature profile in the product is precisely estimated.

Furthermore, a controller implementing the MTM model does not give good results up to the end-point of the sublimation drying, but only for about two-thirds of its duration. Thus these control methods are not able to maximise the product temperature and, at the same time, guarantee the integrity of the product throughout all the main drying.

Figure 5:
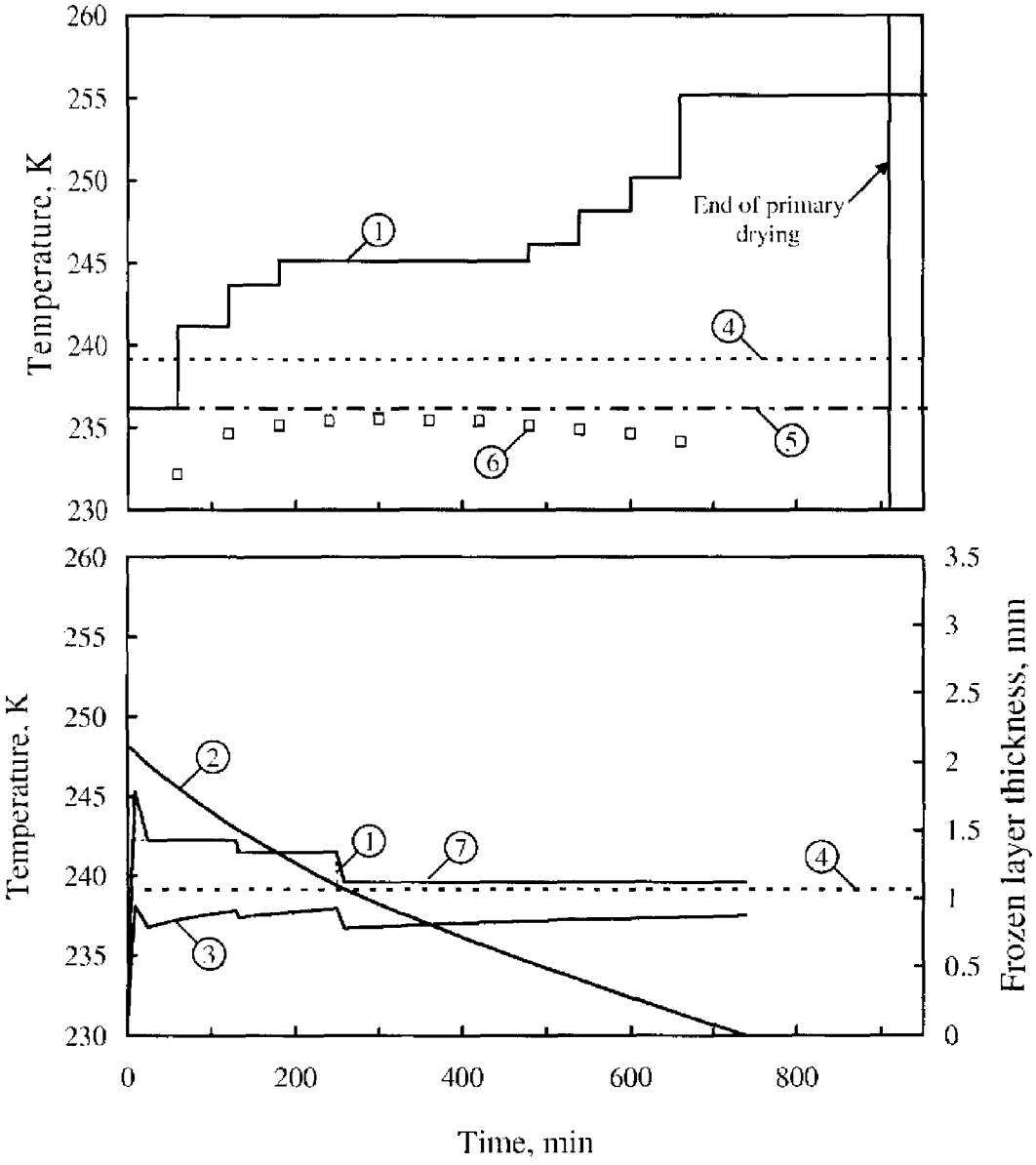
FIG. 5 illustrates a comparison between performance of a known method implementing MTM model (upper graph) and the control method of the invention (lower graph)

This situation is shown in upper graph of FIG. 5, which reproduces an experiment carried out with a controller implementing the MTM model. The lower graph shows the performance of the controller of the invention.

DPE tool can give good results almost up to the end-point of the primary drying stage, and even with a reduced number of containers, or if necessary using a very short time for the pressure rise test, if this is convenient to reduce thermal stresses to the product. Thus the controller can control the entire sublimating drying phase minimising its duration and preserving product quality.

It must be remarked that these results may be obtained because DPE algorithm, which, based on an unsteady state model, accurately estimates also the product resistance, the ice thickness and the heat transfer coefficient simultaneously with the interface product temperature, thus strongly reducing the accumulation error, that affect the accuracy of the prediction in MTM model toward the end of the primary drying. In fact MTM only estimates product resistance $R_p$, and interface temperature and then calculate with assumptions the other quantities.

The DPE ability to give good predictions for very short acquisition times during pressure rise tests (in the first part of primary drying), or equivalently even at the end, when the vapour flow rate is very low, or with a very limited number of containers, is again related to the use of a detailed dynamic model.

It is also possible, after the first run, to calculate the optimal or the minimum acquisition time in the next steps: it is sufficient to run the DPE routine considering different acquisition times, lower than the one actually employed in the experimental run, and find the asymptotic value or estimate a correction, generally of the order of 0.1° C., to be applied in order to estimate with very short acquisition time. The controller, using standard optimisation routines, does this automatically. Adopting the dynamic model of freeze-drying in the container used by DPE estimator and making the same calculations used by the control to predict the future behaviour of the system and described below in the part concerning the control algorithm, the controller can estimate in correspondence of the next control action the new sublimation rate, and thus calculate the optimal acquisition time, using the same procedure above described.

The most important feature that extends the reliability of DPE toward the end of primary drying is the possibility to account for the batch heterogeneity caused by radiating heat contribution or tray edge that is important especially in small freeze driers used for scouting. Actually different containers experience different condition, and not all the containers complete primary drying at the same time. DPE algorithm allows the possibility to estimate the fraction of containers that have completed the process.

In fact, two different options can be adopted by DPE method.

In the first case, described by the set of equations from (eq. 1) to (eq. 11), the batch is considered as a homogenous group of containers, while in the second case (using the Improve Estimation option) DPE considers as optimisation variable a correction coefficient f that takes into account the heterogeneity of the batch or in others word that some containers dry faster than others.

When the Improve Estimation method is adopted, in the previous set of equations, (eq. 7) is substituted by (eq. 7B) as follow:

$$\frac{dp_w}{dt} = f\frac{N_v A}{V_c}\frac{RT_i}{M_w}\frac{1}{R_P}(p_i(T_i) - p_w) \quad \text{for } t > 0 \qquad \text{(eq. 7B)}$$

where $$f = \frac{\sum_{j=1}^{N_v}\left[A_j \frac{k_{1,j}}{L - L_{frozen,j}}(p_i(T_{i,j}) - p_w)\right]}{N_V A \frac{k_1}{L - L_{frozen}}(p_i(T_i) - p_w)} \qquad \text{(eq. 7C)}$$

The correction coefficient f must be evaluated in the same way of $T_{i0}$ and $R_p$.

Thus (Eq. 11) modifies as follows:

Said correction coefficient f is a further parameter to be estimated, using the same procedure previously described for $T_{i0}$ and $R_p$.

$$\min_{T_{i0},R_P,f} \frac{1}{2}\|p_c(T_{i0},R_p, f) - p_{c,mes}\|_2^2 = \frac{1}{2}\sum_j \left(p_c(T_{i0}, R_p, f)_j - (p_{c,mes})_j\right)^2 \qquad \text{(eq. 11B)}$$

Figure 6:
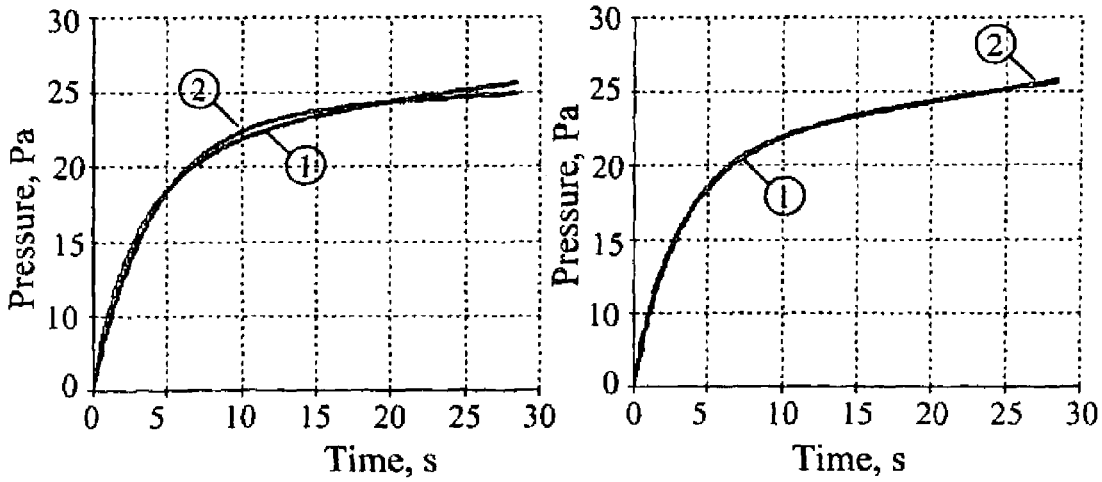
FIG. 6 illustrates pressure rise tests acquired to the end of primary drying phase using the DPE algorithm with Improve Estimation option non enabled (left graph) and with Improve Estimation option enabled (right graph)

Comparing DPE results obtained using both method no meaningful differences has been found at the beginning of primary drying, while close to the end-point of sublimation drying, when radiation effect is more important, the so called Improve Estimation shows a better fitting between experimental (curve number 1) and simulated (curve number 2) pressure rise data as shown in FIG. 6.

The control algorithm of controller comprises a computational engine, which is based on a numerical code, which implements a non stationary mathematical model of the containers and of the freeze drier and an optimization algorithm which uses as inputs the estimations obtained thought the DPE solver. Moreover, the code takes into account a standard Proportional controller in order to control the product temperature and minimize the energy consumption during the primary drying.

The control algorithm comprises the equations below described and the following input parameters: interface temperature $T_{i0}$, frozen layer thickness $L_{frozen}$, mass transfer resistance $R_P$, heat transfer coefficient $K_V$, temperature increase during DPE $\Delta T_{DPE}$ from the DPE estimator; maximum allowable product temperature $T_{MAX}$, thermo-physical parameters, control Logic (Feedback or, feedforward), shelf cooling/heating rate $v_{shelf}$, control horizon time from user or process.

Using a reduced mono-dimensional model for the primary drying, analogue to that adopted for obtaining the DPE estimator, from the material balance at the sublimating interface it is possible to write down an equation which describes the dynamics of frozen layer thickness $L_{frozen}$ during the primary drying:

$$\frac{dL_{frozen}}{dt} = -\frac{1}{\varrho_{II} - \varrho_{Ie}}\frac{M_w}{RT_i}\frac{k_1}{L - L_{frozen}}(p_i(T_i) - p_w) \qquad \text{(eq. 12)}$$

where the effective mass diffusivity $k_1$ in the dried cake is related to the mass resistance $R_p$ by:

$$k_1 = \frac{RT_i}{M}\frac{L - L_{frozen}}{R_P} \qquad \text{(eq. 13)}$$

Pseudo-steady state is assumed in the frozen layer, leading to the following non-linear equation that provides the relation between $L_{frozen}$ and $T_i$:

$$\left(\frac{1}{K_v} + \frac{L_{frozen}}{k_{frozen}}\right)^{-1}(T_{shelf} - T_i) = \frac{\Delta H_s M_w}{RT_i}\frac{k_1}{L - L_{frozen}}(p_i(T_i) - p_w) \qquad \text{(eq. 14)}$$

while the temperature at the bottom of the product is given by:

$$T_B = T_{shelf} - \frac{1}{K_v}\left(\frac{1}{K_v} + \frac{L_{frozen}}{k_{frozen}}\right)^{-1}(T_{shelf} - T_i) \qquad \text{(eq. 15)}$$

The parameters of the equations used for the control, not previously described in the previous section, are the followings:

| | |
|---|---|
| e | error |
| $k_1$ | effective diffusivity coefficient [$m^2 s^{-1}$] |
| $K_{OPT}$ | optimum gain of the controller |
| $T_{MAX}$ | maximum allowable temperature for the product |
| $v_{shelf}$ | cooling or heating rate of the shelf |
| $\Delta T_{DPE}$ | maximum temperature increase during DPE run |

-continued

| Subscripts and superscripts in the equations are: | |
|---|---|
| I | referred to dried layer |
| II | referred to frozen layer |
| e | effective |
| SP | set point value |

The previous equations are integrated from the current time ($t_0$) up to the estimated end of the process ($t_N$), corresponding to the time when $L_{frozen}$ becomes equal to zero. The time interval $\Delta t_{PH}=t_N-t_0$ defines the Prediction Horizon, i.e. the time along which the controlled process is simulated in order to determine the optimal control policy.

The optimal sequence of $T_{shelf}$ set-point values is determined as a piecewise-linear function.

The control method of the invention provides two different approaches to calculate the optimal set-point shelf temperature: a feedback method and a feedforward method. The main difference between these methods is that the Feedback method bases its action on what has happened in the past, while the feedforward method uses directly the process model to compute the shelf temperature needed to maintain the product at its limit.

In the feedback method the set-point sequence is computed as:

$$T_{SP}(t): \quad \text{(eq. 16A)}$$

$$\begin{cases} T_{SP,1} = T_{shelf}(t_0) + K_{OPT}(T_B(t_0) - T_{B,SP}) & t_0 \le t < t_1 \\ T_{SP,2} = T_{shelf}(t_1) + K_{OPT}(T_B(t_1) - T_{B,SP}) & t_1 \le t < t_2 \\ \vdots \\ T_{SP,N} = T_{shelf}(t_{N-1}) + K_{OPT}(T_B(t_{N-1}) - T_{B,SP}) & t_{N-1} \le t < t_N \end{cases}$$

where each $\Delta t_{CH}=t_j-t_{j-1}$ defines a control time horizon, i.e. the time interval after which the shelf temperature set-point is modified; $e(t_j)=T_B(t_j)-T_{B,SP}$ is the error between the product temperature at the container bottom and the corresponding set-point value, i.e. the temperature value the product is driven to. In each interval, $T_{SP,j}$ is constant and its value is computed proportionally to $e(t_{j-1})$. $K_{OPT}$ is the gain of the controller. It must be pointed out that the control horizon may coincide with the time interval between two subsequent DPEs, but one or more control actions may be allowed between two DPEs.

The value of the gain of the controller is selected according to the criterium of the minimisation of the predicted integral square error (ISE), given by:

$$\min_{K_{OPT}}(ISE) = \min_{K_{OPT}} \int_{t_0}^{t_N} (T_B(t) - T_{B,SP})^2 \, dt \quad \text{(eq. 17A)}$$

where $T_B(t)$ is the product bottom temperature as calculated from the previous equations integrated in time from $t_0$ to $t_N$. By this way, the tuning of the controller is performed with an adaptive strategy in which the controller gain is iterated until a minimum ISE is reached. The Golden Search Method is used to perform the optimization (this is a commonly used optimization method).

If a feedforward approach is selected, the optimal sequence of shelf temperature set-points is calculated from equation 15 imposing the value of $T_B$ to be equal to $T_{B,SP}$:

$$T_{SP}(t): \begin{cases} T_{SP,1} = T_{B,SP} - \left[1 - K_v\left(\frac{1}{K_v} + \frac{L_{frozen}(t_0)}{k_{frozen}}\right)(T_{B,SP} - T_i(t_0))\right]^{-1} & t_0 \le t < t_1 \\ T_{SP,2} = T_{B,SP} - \left[1 - K_v\left(\frac{1}{K_v} + \frac{L_{frozen}(t_1)}{k_{frozen}}\right)(T_{B,SP} - T_i(t_1))\right]^{-1} & t_1 \le t < t_2 \\ \vdots \\ T_{SP,N} = T_{B,SP} - \left[1 - K_v\left(\frac{1}{K_v} + \frac{L_{frozen}(t_{N-1})}{k_{frozen}}\right)(T_{B,SP} - T_i(t_{N-1}))\right]^{-1} & t_{N-1} \le t < t_N \end{cases} \quad \text{(eq. 16B)}$$

In both cases 1) and 2), the above described sequences of $T_{SP,j}$ (j=1,N) are calculated accounting for the real dynamics of cooling/heating of the shelf, given by the velocity $v_{shelf}$:

$$T_{shelf}(t): \begin{cases} \frac{dT_{shelf}}{dt} = v_{shelf} & t_{j-1} \le t < t_{SP,j} \\ T_{shelf}(t) = T_{SP,j} & t_{SP,j} \le t < t_j \end{cases} \quad \text{(eq. 18)}$$

where $t_{SP,j}$ is the time when the set-point is reached and the $T_{shelf}$ is not required to change anymore, given by:

$$t_{SP,j} = t_{j-1} + \int_{T_{shelf}(t_{j-1})}^{T_{SP,j}} \frac{1}{v_{shelf}} \, dT_{shelf} \quad \text{(eq. 19)}$$

$v_{shelf}$ has different values for heating and cooling, respectively positive and negative, and an appropriate value can be used for each temperature interval.

In practice, equations (18-19) mean that the controlled process (eq. 12-15) is simulated using a $T_{shelf}$ that changes according to $v_{shelf}$ and remains constant when the set-point value has been reached.

Finally, the target value of the product temperature, $T_{B,SP}$, is calculated iteratively in such a way that the product temperature $T_B$ never overcomes the maximum allowable value $T_{MAX}$, even during the pressure rise test. Mathematically, this corresponds to find the highest $T_{B,SP}$ value that satisfies the condition that the maximum product temperature imposed by the user is higher than the maximum product overshoot estimated through the previous equations, augmented by the maximum temperature increase measured by the DPE estimator:

$$T_{MAX} > \max_{\substack{T_{MAX} > \max(T_B(t)) + \Delta T_{DPE} \\ t = t_0 \ldots t_N}}(T_{B,SP}) \quad \text{(eq. 20A)}$$

If instead of DPE a different system or device is used to estimate input parameters to the control system, which causes no temperature increase during the measure, the maximum allowable value $T_{MAX}$ is calculated by:

$$T_{MAX} > \max_{\substack{T_{MAX} > max(T_B(t)) \\ t=t_0 \ldots t_N}}(T_{B,SP}) \quad \text{(eq. 20B)}$$

Both control methods implemented into controller refers to a target temperature, which is obtained by the bound temperature set by the user, $T_{max}$ (for example the collapse or the melting temperature). This approach is more efficient than that used in the known methods that define the target as the limit decreased of a security margin that should ensure that also in the worst condition the maximum product temperature will be never overcome, but, on the other hand, risk to be too conservative.

The control system, by means of equation (eq. 18) takes into account the thermal dynamics of the freeze-drier; the heating and cooling rate are given as inputs, but it has self-adaptive features, and is able to update their value by measuring the rate of shelf temperature variation during the process.

The following are the main passages useful for calculating the cooling rates during a cooling step:

defining a defined number of temperature intervals where the cooling rates will be calculated;

during the cooling step, collecting the shelf temperature throughout all the temperature intervals that apply by means of either thermocouples (shelf temperature) or using data directly acquired by the internal control system of the freeze-drier (fluid temperature);

calculating the cooling rate for each interval as follows:

$$r_i = \frac{1}{n}\sum_{j=2}^{n}\left(\frac{(T_f(j) - T_f(j-1))}{(t(j) - t(j-1))}\right) \quad \text{(eq. 21)}$$

where:

| | |
|---|---|
| $r_i$ | cooling rate for the temperature interval i, K/min; |
| n | number of data acquired in the interval i; |
| $T_f$ | shelf temperature, K; |
| t | time, s. |

updating the value of the cooling rate for the defined interval and for other intervals applying the same factor, to be used for the next step calculation.

By this way it is possible to take into account variation in the cooling rate connected to changes by any reason (change of auxiliary cooling water temperature, etc).

In general the cooling rate during the freezing stage is higher than during drying. Anyway it is possible to routinely calibrate the system applying the same procedure described above during the entire freezing step, and by comparison with the set of data stored in memory calculate a correction factor, that can be related to change in the conditions of the apparatus. The set of cooling rate in primary drying can be reset before the start of the drying, multiplying previous values by the correction factor thus calculated.

In order to determine the actual heating capacity of the freeze drier, steps 1-4 will be applied during the first heating step of the primary drying.

With the outcomes coming from a DPE test (i.e. front temperature, frozen layer thickness, mass and heat transfer coefficients, etc.) and some process variables (i.e. current shelf temperature, pressure chamber, cooling rate of the drier, etc.), the control algorithm can estimate the time varying product temperature at the bottom of the vial (where the temperature is higher) taking also into account the temperature variation during next DPE test. Furthermore, the mathematical model of control algorithm considers the dynamics of the freeze drier to heat or to cool the system.

Figure 8:
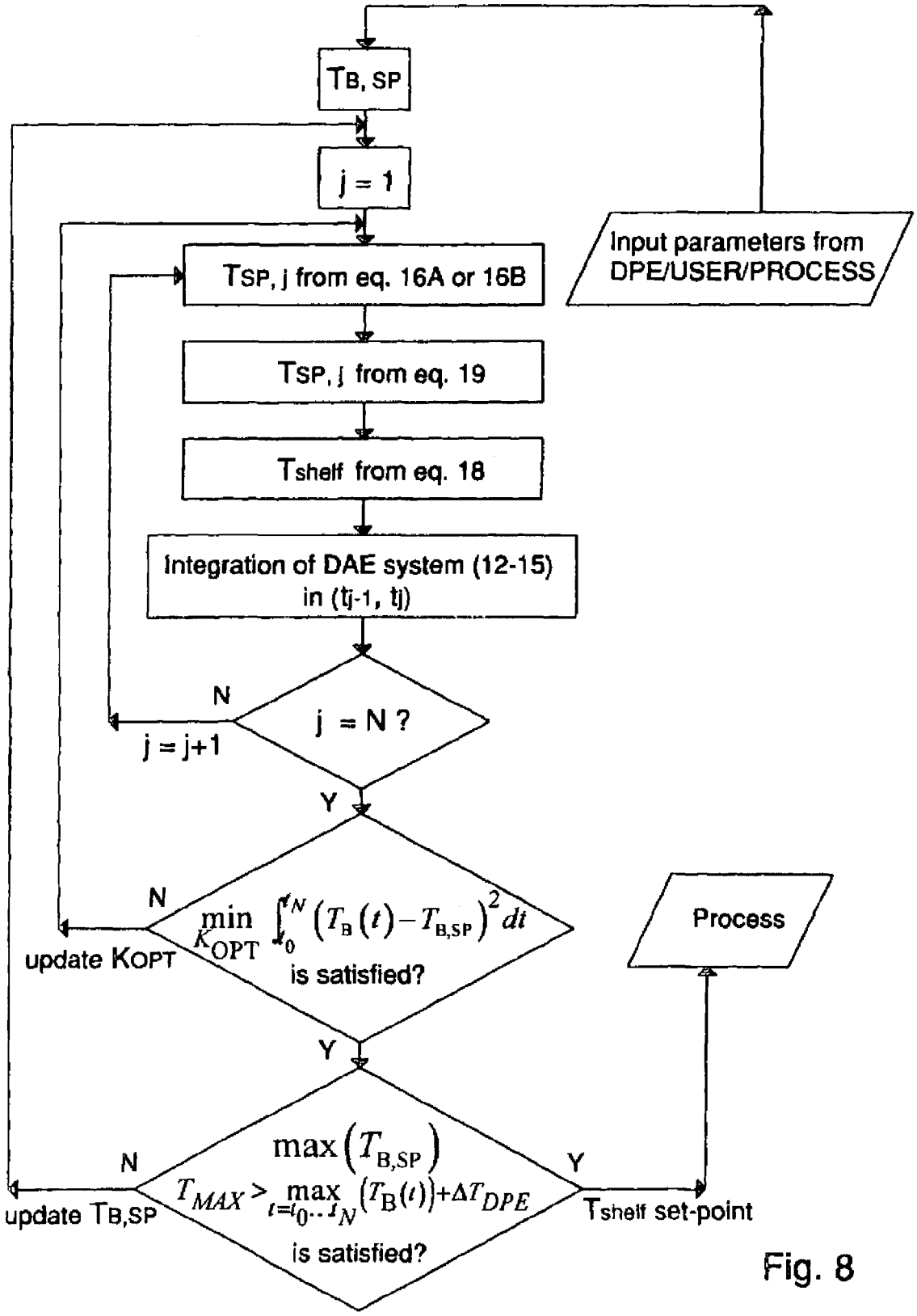
FIG. 8 is a flowchart showing a calculating procedure of a control algorithm implemented in the method of the invention.

FIG. 8 is the flowchart showing a calculating procedure of a control algorithm implemented in the method of the invention.

In the first step, the shelf temperature is raised and the product is heated at the maximum heating rate compatible with the system capacity. The duration of this first step is chosen by the user. When the first DPE run is carried out (and after that at each successive DPE run), an optimal set-point shelf temperature sequence is calculated throughout the control horizon time chosen.

If the estimated product temperature would approach the fixed limit in any of the interval of the control horizon, the $T_{SP}$ is reduced in order that the product temperature does not overcome this limit and does not jeopardize the integrity of the material subjected to drying.

A constant temperature can be assumed in each control step, or several subintervals can be adopted. Experience shows that there is generally no advantage in splitting in more than 2 part if a time interval of 30-60 minutes is adopted between different DPE test. This option can become more effective if a limited number of DPE test is carried out to reduce the thermal stress to the product, in case of very sensitive material.

Figure 7:
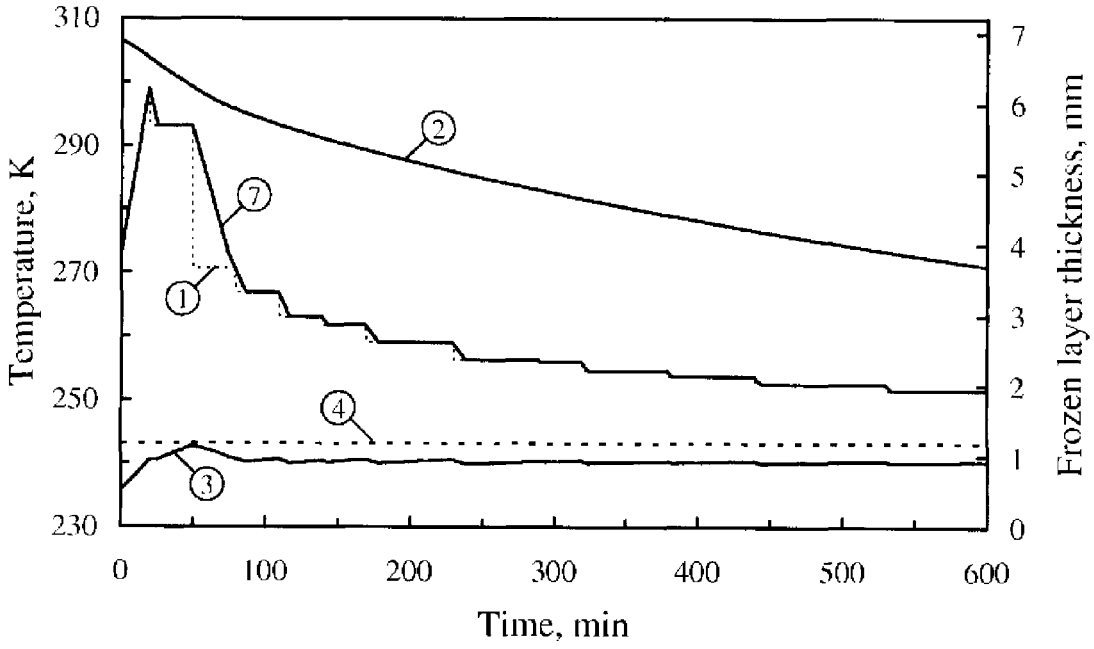
FIG. 7 is a graph showing a sequence of set-point shelf temperature computed by control system after the first DPE computation.

Several control strategies can be selected by the user that minimise the main drying time without impairing the product integrity, respecting also additional constraints set by the user. Two of these will be shown for exemplification purposes. As stated beforehand, the first control action involves always an initial heating step, during which the product is heated at the maximum heating rate compatible with the actual system capacity. By this way, the product can reach as fast as possible its bound minimising the drying time. In a first control strategy, shown in FIGS. 4, 6, 7 after this first stage, where the cycle is more aggressive, the controller does not allow increasing again the shelf temperature once it has been reduced, setting a sequence of cooling steps that maintains the product temperature under the maximum allowed one. This strategy is relatively prudent, because after the initial period, if the product temperature is lower than its limit, the controller stops cooling (the shelf temperature is maintained constant) and the product temperature starts rising because of process phenomena, but this happens very slowly.

An alternative control strategy can be selected where the controller is allowed to increase the shelf temperature at any step. In this manner, the product quickly approaches its boundary limit during the first heating and is maintained closed to its limit throughout all the primary drying, thus reducing the drying time to its absolute minimum. This would lead to a more aggressive control action. If this second strategy is used, to tune the proportional controller in the feedback control logic, it is convenient to substitute the minimisation criterium given by (eq. 17A) with the minimisation of the cost function given by:

$$F = \int_{t_0}^{t_h} \frac{1}{t} \cdot e^2(t) \cdot dt \quad \text{(eq. 17B)}$$

where:

| | |
|---|---|
| e | difference between the bottom product temperature and its limit [K]; |
| F | cost function; |
| t | time [s]; |

-continued

| | |
|---|---|
| $t_0$ | initial time [s]; |
| $t_h$ | horizon time [s]. |

This cost function minimises the square difference between the current product temperature and its target divided by the time elapsed from the beginning of the horizon time. By this way more importance is given to what happens nearby the current control action and, at the same time, less and less weight to what happens later.

Finally, control algorithm is able to estimate the time-varying frozen layer thickness according to the shelf temperature trend estimated, therefore it can predict the time at which the primary drying will be finished (thickness of the frozen layer equals to zero), that corresponds to its prediction horizon.

In order to run the controller, the user must set the control horizon time, which is the time between a control action and next one. The most efficient choice is to set it corresponding to the interval between two DPE runs. After that, controller calculates a sequence of set-point shelf temperatures (one for each control interval throughout the horizon time) in such a way that the product temperature is as close as possible to the limit temperature (see FIG. 7 that shows a sequence of set-point shelf temperature computed by controller after the first DPE, with prediction horizon time=600 min, control horizon time=30 min).

At the end of each control time a new DPE test will be carried out, which updates the state of the system, and a new sequence of set-point shelf temperatures will be computed. In this manner, it is possible to overcome some problems connected, for instance, with the mismatch between the estimation of the model and the process.

At the end of primary drying generally the control changes chamber pressure set point and shelf temperature, rising it. It can determine the end of primary drying by calculating when the frozen layer is reduced to zero.

An alternative automatic way is available, to confirm that primary drying is really completed: it considers the sublimated solvent mass evolution.

The main steps of this procedure are the following:

performing a pressure rise test and calculating the current solvent mass as the tangent of the pressure rise curve at the beginning of the test;

integrating the solvent mass flow versus time in order to get the actual cumulative sublimated mass curve; the primary drying can be considered finished when the sublimated mass curve reaches a plateau.

calculating a stop coefficient that is directly related to the average sublimating mass rate and it is used as reference for establishing whether or not the main drying is finished, taking into account the similarity between curves in different cycles:

$$\bar{r}_s(i) = \frac{m(i) - m(i-1)}{m_{tot} \cdot (t(i) - t(i-1))} \cdot 100 \qquad \text{(eq. 22)}$$

where:

| | |
|---|---|
| m | sublimated solvent mass [kg]; |
| t | time [h]; |
| $r_s$ | sublimating mass rate [kg $s^{-1}$]. |

comparing the current $r_s$ with a limit value set by the user, which consists in the percentage variation of the sublimated solvent mass with respect to the total one (for example 1%/h). If $r_s$ is lower than this limit and the estimated frozen layer thickness is not close to the initial one, confirming that the process is not at the beginning, when the sublimation rate can be low due to the low initial product temperature, the primary drying can be considered finished.

FIG. 4 shows an example of an experimental freeze-drying cycle run using the method of the invention for controlling the shelf temperature, namely the heating fluid temperature. The cycle is shortened, without risk for the product, because, as the future temperature of the product is predicted, since the beginning the heating up is set at the maximum value allowed, and overshoot is avoided taking also into account the cooling dynamics of the apparatus. It can be noticed that the product temperature detected through thermocouples at the bottom never overcomes the limit temperature not even in correspondence of the DPE tests when the temperature increases. Besides, it can be pointed out that DPE gives good results up to the end of the primary drying phase, estimated as shown before, and the product temperature estimated agrees with thermocouple measurements, at least until the monitored vials are representative of the entire batch.

Owing to the method and system of the invention is thus possible to estimate the time-varying product temperature throughout the prediction horizon time and to determine the control action as function of both the current process state and its future evolution. By this way, the control system can potentially determine, after an initial DPE test, the optimal set-point shelf temperature sequence and, thus, an optimal freeze-drying cycle.

FIG. 5 shows an example of a state-of-the-art freeze-drying cycle controlled by a control system implementing MTM model using U.S. Pat. No. 6,971,187 approach (upper graph) and freeze-drying cycle controlled by the control system of the invention (lower graph) for the same product.

It can be pointed out that control system of the invention applies a more aggressive heating strategy with respect to the MTM based control system and, thus, this can be translated in a more important decreasing of the drying time. In fact, in the first case the primary drying ended after 16 hours, while in the second one after 12.5 hours (compare the curve of the frozen layer thickness). Furthermore, since MTM model is unable to give good results after 11.5 hours, the MTM control system cannot be run and, thus, the product temperature cannot be controlled anymore.

LEGEND OF FIGURES

FIG. 4

(1) measured shelf temperature, ° C.;

(2) set-point shelf temperature, ° C.;

(3) product temperature measured by thermocouples inserted in the product close to the bottom, ° C.;

(4) Bottom product temperature estimated through DPE, ° C.

FIG. 5

(1) (dashed line) Set point shelf temperature $T_{SP}$, K;

(2) frozen layer thickness, mm;

(3) estimated product bottom temperature evolution $T_B$, K;

(4) maximum allowable product temperature $T_{MAX}$, using DPE, K;

(5) maximum allowable product temperature $T_{MAX}$, using MTM, K;

(6) bottom product temperature estimated through MTM, K;

(7) actual shelf temperature, K (continuous line);

FIG. 6

Left Hand side: Improve Estimation option not enabled

Right hand side: Improve Estimation option enabled (1) Experimental chamber pressure, Pa;

(2) Chamber pressure rise estimated through DPE, Pa.

FIG. 7

(1) (dashed line) Set point shelf temperature $T_{SP}$, K;

(2) estimated frozen layer thickness, mm;

(3) estimated product bottom temperature evolution $T_B$, K;

(4) maximum allowable product temperature $T_{MAX}$ [K];

(7) (continuous line) actual shelf temperature, K.

The invention claimed is:

1. Method for monitoring and/or controlling a freeze drying process in a freeze dryer apparatus provided with a drying chamber having a temperature-controlled shelf supporting containers of a product to be dried, said drying chamber being connected to a condenser chamber, comprising during a primary drying phase of said freeze drying process the steps of:

isolating, for a time period, said drying chamber from said condenser chamber by closing an isolating valve thereof and sensing and collecting pressure values ($p_{c,mes}$) inside said drying chamber for a pressure collecting time ($t_f$) and a shelf temperature ($T_{shelf}$) of said temperature-controlled shelf (Step 1) (Pressure rise test);

calculating a product temperature (T) of product and a plurality of process/product related parameters (Step 2), said calculating comprising calculating:

product temperature ($T_{i0}$) at a sublimation interface of product;

mass transfer resistance ($R_p$) in a dried portion of product;

product temperature (T=T(z,t)) at an axial coordinate (z) and at a time (t) during said pressure collecting time ($t_f$);

heat transfer coefficient ($K_v$) between said temperature-controlled shelf and said container;

thickness ($L_{frozen}$) of a frozen portion of product;

mass flow in the drying chamber;

remaining primary drying time;

calculating a new shelf temperature using said calculated product temperature and said calculated process/product related parameters (Step 3) and adjusting a temperature of said temperature-controlled shelf on the basis of said new shelf temperature;

wherein said calculating said product temperature and said plurality of process/product related parameters is made by means of an estimator algorithm, which implements an unsteady state model for mass transfer in said drying chamber and for heat transfer in the product, and comprises the following equations:

$$\frac{\partial T}{\partial t} = \frac{k_{frozen}}{\varrho_{frozen} c_{P,frozen}} \frac{\partial^2 T}{\partial z^2} \quad \text{for } t > t_0,\ 0 < z < L_{frozen} \tag{eq. 1}$$

$$T|_{t=0} = T_{i0} + \frac{z}{k_{frozen}} \frac{\Delta H_s}{R_P}(p(T_{i0}) - p_{w0}) \quad I.C.:\ t = 0,\ 0 < z < L_{frozen} \tag{eq. 2}$$

-continued $$k_{frozen} \frac{\partial T}{\partial z}\bigg|_{z=0} = \frac{\Delta H_s}{R_P}(p(T_i) - p_w) \quad B.C.1:\ t \geq 0,\ z = 0 \tag{eq. 3}$$

$$k_{frozen} \frac{\partial T}{\partial z}\bigg|_{z=L} = K_v(T_{shelf} - T_B) \quad B.C.2:\ t \geq 0,\ z = L_{frozen} \tag{eq. 4}$$

$$K_v = \left[ \frac{T_{shelf} - T_{i0}}{\frac{\Delta H_s}{R_P}(p(T_{i0}) - p_{w0})} + \frac{L_{frozen}}{k_{frozen}} \right]^{-1} \tag{eq. 5}$$

$$T_{B0} = T_{i0} + \frac{L_{frozen}}{k_{frozen}} \frac{\Delta H_s}{R_P}(p(T_{i0}) - p_{w0}) \tag{eq. 6}$$

$$\frac{dp_w}{dt} = \frac{N_v A}{V_c} \frac{RT_i}{M_w} \frac{1}{R_P}(p_i(T_i) - p_w) \quad \text{for } t > 0 \tag{eq. 7}$$

$$p_c = p_w + p_{in} = p_w + F_{leak} \cdot t + p_{in0} \quad \text{for } t \geq 0 \tag{eq. 8}$$

$$p_w|_{t=0} = p_{c0} - p_{in0} \quad I.C.:\ t = 0 \tag{eq. 9}$$

$$\varrho_{frozen} A L_{frozen,n} + \varrho_{dried} A(L - L_{frozen,n}) = \varrho_{frozen} A L_{frozen,n-1} - \frac{K_v A}{\Delta H_s}(T_{shelf} - T_{B0}) \times \Delta t_{n-1} \tag{eq. 10}$$

where $$T = T(z, t),\ T_i = T(t)\bigg|_{z=0},\ T_B = T(t)\bigg|_{z=L},\ T_{i0} = T\bigg|_{z=0,t=0};$$

and the parameters in the equations are:

| | |
|---|---|
| A | internal cross surface of the container [$m^2$] |
| $c_P$ | specific heat at constant pressure [J $kg^{-1}$ $K^{-1}$] |
| $c_{P,frozen}$ | frozen layer specific heat at constant pressure [J $kg^{-1}$ $K^{-1}$] |
| $F_{leak}$ | leakage rate [Pa $s^{-1}$] |
| k | thermal conductivity [J m $s^{-1}$ K] |
| $K_v$ | overall heat transfer coefficient [J $m^{-2}$ $s^{-1}$ K] |
| $k_{frozen}$ | frozen layer thermal conductivity [J m $s^{-1}$ K] |
| L | total product thickness [m] |
| $L_{frozen}$ | frozen layer thickness [m] |
| M | molecular weight [kmol $kg^{-1}$] |
| $M_w$ | water vapour molecular weight [kmol $kg^{-1}$] |
| $N_v$ | number of containers |
| p | pressure [Pa] |
| R | ideal gas Constant [J $kmol^{-1}$ K] |
| $R_p$ | mass transfer resistance in the dried layer [$m^{-1}$ s] |
| T | Temperature [K] |
| t | time [s] |
| $T_B$ | frozen layer temperature at z = L [K] |
| V | Volume [$m^3$] |
| $V_c$ | drying chamber volume [$m^3$] |
| z | axial coordinate [m] |
| ρ | mass density [kg $m^{-3}$] |
| $\Delta H_s$ | enthalpy of sublimation [J $kg^{-1}$] |
| $\rho_{frozen}$ | mass density of frozen layer [kg $m^{-3}$] |
| $\rho_{dried}$ | mass density of dried layer [kg $m^{-3}$] |
| $L_{frozen,n}$ | frozen layer thickness to be calculated in the actual pressure rise test [m] |
| $L_{frozen,n-1}$ | frozen layer thickness calculated in a previous pressure rise test [m] |
| $p_c$ | drying chamber pressure [Pa] |
| $p_{c0}$ | drying chamber pressure at t = 0 [Pa] |
| $p_w$ | water vapour pressure [Pa] |
| $p_{w0}$ | water vapour pressure at t = 0 [Pa] |
| $p_{pin}$ | inert gas pressure [Pa] |
| $p_{in0}$ | inert gas pressure at t = 0 [Pa] |
| $T_{B0}$ | frozen layer temperature at z = L and t = 0 [K] |
| $\Delta t_{n-1}$ | total time passed between the actual and the preceding pressure rise test |
| $T_{shelf}$ | temperature of temperature-controlled shelf |

the subscripts and superscripts in the equations are:

| | |
|---|---|
| 0 | value at z = 0 |
| frozen | frozen layer |
| dried | dried layer |

-continued

| | |
|---|---|
| c | chamber |
| i | interface |
| in | inert gas |
| mes | measured |
| shelf | heating shelf |
| w | water vapour |

$[t_0, t_f]$ is the interval of Step 1;

I.C. are initial conditions, B.C are boundary conditions.

2. Method according to claim 1, wherein calculating said product temperature and said plurality of process/product related parameters comprises the following step:

assigning values to $T_{i0}$, $R_p$ parameters (Step 11);

calculating values of $T_{BO}$, $K_v$, $L_{frozen}$ parameters respectively by means of equations (eq. 6), (eq. 5), (eq. 10) (Step 12);

calculating an initial temperature $T|_{t=0}$ of frozen product by means of equation (eq. 2) (Step 13);

integrating the equation (eq. 1) in said interval $[t_0, t_f]$ of Step 1 (Step 14);

repeating step 12 to 14 up to solve a non-linear least square problem:

$$\min_{T_{i0},R_P} \frac{1}{2}\|p_c(T_{i0}, R_P) - p_{c,mes}\|_2^2 = \frac{1}{2}\sum_j \left(p_c(T_{i0}, R_P)_j - (p_{c,mes})_j\right)^2 \quad \text{(eq. 11)}$$

so as to determine values of $T_{i0}$, $R_p$ that fit a simulated drying chamber pressure ($p_c(T_{i0},R_p)$) to said pressure values ($p_{c,mes}$)

where j index of summation of capital-sigma notation;

calculating said product temperature (T=T(z,t)).

3. Method according to claim 1, wherein said estimator algorithm further comprises a correction coefficient (f) that takes into account heterogeneity of a batch of said containers, said correction coefficient (f) being defined by the equation:

$$f = \frac{\sum_{j=1}^{N_V}\left[A_j \frac{k_{1,j}}{L - L_{frozen,j}}(p_i(T_{i,j}) - p_w)\right]}{N_V A \frac{k_1}{L - L_{frozen}}(p_i(T_i) - p_w)} \quad \text{(eq. 7C)}$$

Where $k_1$ effective diffusivity coefficient [$m^2 s^{-1}$]

j index of summation of capital-sigma notation.

4. Method according to claim 3, wherein calculating said product temperature and said plurality of process/product related parameters comprises the following step:

assigning values to $T_{i0}$, $R_p$ parameters (Step 11);

calculating values of $T_{BO}$, $K_v$, $L_{frozen}$ parameters respectively by means of equations (eq. 6), (eq. 5), (eq. 10) (Step 12);

calculating an initial temperature T|t=0 of frozen product by means of equation (eq. 2) (Step 13);

integrating the equation (eq. 1) in said interval $[t_0, t_f]$ of Step 1 (Step 14);

repeating step 12 to 14 up to solve a non-linear least square problem:

$$\min_{T_{i0},R_P} \frac{1}{2}\|p_c(T_{i0}, R_P) - p_{c,mes}\|_2^2 = \frac{1}{2}\sum_j \left(p_c(T_{i0}, R_P)_j - (p_{c,mes})_j\right)^2 \quad \text{(eq. 11)}$$

so as to determine values of $T_{i0}$, $R_p$ that fit a simulated drying chamber pressure ($p_c(T_{i0},R_p)$) to said pressure values ($p_{c,mes}$);

calculating said product temperature (T=T(z,t));

and said correction coefficient (f) is inserted in equations (eq. 7, eq. 11) of estimator algorithm which are modified in:

$$\frac{dp_w}{dt} = f\frac{N_v A}{V_c}\frac{RT_i}{M_w}\frac{1}{R_P}(p_i(T_i) - p_w) \text{ for } t > 0 \quad \text{(eq. 7B)}$$

$$\min_{T_{i0},R_P,f} \frac{1}{2}\|p_c(T_{i0}, R_P, f) - p_{c,mes}\|_2^2 = \frac{1}{2}\sum_j \left(p_c(T_{i0}, R_P, f)_j - (p_{c,mes})_j\right)^2 \quad \text{(eq. 11B)}$$

where j index of summation of capital-sigma notation.

5. Method according to claim 1, comprising repeating said Step 1 and Step 2 (at intervals of 30 minutes).

6. Method according to claim 1, wherein said calculating said new shelf temperature comprises calculating a new shelf temperature and a sequence of shelf temperatures up to the end of the primary drying phase, that maximises a sublimation rate of said product maintaining the product temperature below a maximum allowable product temperature (Step 3).

7. Method according to claim 6, wherein said new shelf temperature and said sequence of shelf temperatures is such as to drive the product to a desired target temperature.

8. Method according to claim 7, wherein said desired target temperature is lower than said maximum allowable product temperature by an amount ranging from 1 to 3° C.

9. Method according to claim 6, comprising repeating said Steps 1 to 3 (at intervals of 30 minutes).

10. Method according to claim 6, wherein said calculating said new shelf temperature and/or said sequence of shelf temperatures is made by means of a control algorithm, based on a numerical code, which implements a non-stationary mathematical model of containers and of freeze dryer apparatus and an optimization algorithm which uses as inputs said product temperature and said plurality of process/product related parameters calculated in a previous step (step 2).

11. Method according to claim 10, wherein said control algorithm comprises a PID type controller for controlling a product temperature and for minimizing an energy consumption during said primary drying phase.

12. Method according to claim 10, where said control algorithm comprises the following equations:

$$\frac{dL_{frozen}}{dt} = -\frac{1}{\tilde{n}_{II} - \tilde{n}_{Ie}}\frac{M_w}{RT_i}\frac{k_1}{L - L_{frozen}}(p_i(T_i) - p_w) \quad \text{(eq. 12)}$$

$$k_1 = \frac{RT_i}{M}\frac{L - L_{frozen}}{R_P} \quad \text{(eq. 13)}$$

-continued $$\left(\frac{1}{K_v}+\frac{L_{frozen}}{k_{frozen}}\right)^{-1}(T_{shelf}-T_i)=\frac{\Delta H_s M_w}{RT_i}\frac{k_1}{L-L_{frozen}}(p_i(T_i)-p_w) \quad \text{(eq. 14)}$$

$$T_B=T_{shelf}-\frac{1}{K_v}\left(\frac{1}{K_v}+\frac{L_{frozen}}{k_{frozen}}\right)^{-1}(T_{shelf}-T_i) \quad \text{(eq. 15)}$$

$$T_{SP}(t): \quad \text{(eq. 16A)}$$

$$\begin{cases} T_{SP,1}=T_{shelf}(t_0)+K_{OPT}(T_B(t_0)-T_{B,SP}) & t_0\le t<t_1 \\ T_{SP,2}=T_{shelf}(t_1)+K_{OPT}(T_B(t_1)-T_{B,SP}) & t_1\le t<t_2 \\ \vdots & \\ T_{SP,N}=T_{shelf}(t_{N-1})+K_{OPT}(T_B(t_{N-1})-T_{B,SP}) & t_{N-1}\le t<t_N \end{cases}$$

$$\min_{K_{OPT}}(ISE)=\min_{K_{OPT}}\int_{t_0}^{t_N}(T_B(t)-T_{B,SP})^2\,dt \quad \text{(eq. 17A)}$$

$$F=\int_{t_0}^{t_h}\frac{1}{t}\cdot e^2(t)\cdot dt \quad \text{(eq. 17B)}$$

or $$T_{MAX}>\max_{\substack{T_{MAX}>max(T_B(t))+\Delta T_{DPE}\\ t=t_0\ldots t_N}}(T_{B,SP}) \quad \text{(eq. 20A)}$$

where the parameters in the equations are:

| | |
|---|---|
| e | error |
| $k_1$ | effective diffusivity coefficient [$m^2 s^{-1}$] |
| $K_{OPT}$ | optimum gain of the controller |
| $K_v$ | overall heat transfer coefficient [$J m^{-2} s^{-1} K$] |
| L | total product thickness [m] |
| $L_{frozen}$ | frozen layer thickness [m] |
| M | molecular weight [$kmol kg^{-1}$] |
| p | pressure [Pa] |
| R | ideal gas Constant [$J kmol^{-1} K$] |
| $R_p$ | mass transfer resistance in the dried layer [$m^{-1} s$] |
| T | Temperature [K |
| t | time [s] |
| $T_B$ | frozen layer temperature at z = L [K] |
| $T_{MAX}$ | maximum allowable temperature for the product |
| $T_{SP}$ | Set point shelf temperature [K] |
| $\Delta T_{DPE}$ | maximum temperature increase during DPE run |
| ρ | mass density [$kg m^{-3}$] |
| $v_{shelf}$ | cooling or heating rate of the shelf |
| $\Delta H_s$ | enthalpy of sublimation [$J kg^{-1}$] |
| $T_{B,SP}$ | set point value of frozen layer temperature at z = L [K] |
| $\rho_{II}$ | frozen layer mass density [$kg m^{-3}$] |
| $\rho_{Ie}$ | effective dried layer mass density [$kg m^{-3}$] |
| $T_{shelf}$ | temperature of temperature-controlled shelf |

subscripts and superscripts are:

| | |
|---|---|
| I | referred to dried layer |
| II | referred to frozen layer |
| e | effective |
| SP | set point value |
| i | interface |
| ISE | integral square error |

where the parameters in equation (eq. 17B) are:

| | |
|---|---|
| e | difference between the bottom product temperature and its limit [K]; |
| F | cost function; |
| t | time [s]; |
| $t_0$ | initial time [s]; |
| $t_h$ | horizon time [s]. |

13. Method according to claim 12, wherein calculating at least said new shelf temperature comprises the following step:

entering said plurality of product/process related parameters and other process/user parameters comprising liquid volume filling each container, number of loaded containers, volume of drying chamber, thermo-physical characteristics of solvent present in product (if different from water), maximum allowable product temperature, control logic selected, horizon and control time;

calculating a relation between $L_{frozen}$ and Ti and a frozen layer temperature by means of equations (eq. 12), (eq. 13), (eq. 14), (eq. 15);

calculating an optimal sequence of set-point temperature values by means of equation (eq. 16A) and equation (eq. 17A) or (eq. 17B) in case of feedback logic, or by means of equation (eq. 16B) in case of feedback logic, and equations (eq. 18), (eq. 19);

calculating an updated product temperature ($T_{B,SP}$) and a new shelf temperature ($T'_{shelf}$) by means of equation (eq. 20A).

14. Method according to claim 13, further comprises the following steps for calculating cooling/heating rates during a cooling/heating step of said primary drying phase:

defining a defined number of temperature intervals where said cooling/heating rates will be calculated;

during said cooling/heating step collecting the shelf temperature throughout all temperature intervals;

calculating the cooling/heating rate for each interval by means of equation:

$$r_i=\frac{1}{n}\sum_{j=2}^{n}\left(\frac{(T_f(j)-T_f(j-1))}{(t(j)-t(j-1))}\right) \quad \text{(eq. 21)}$$

where:

| | |
|---|---|
| $r_i$: | cooling/heating rate for the temperature interval i, K/min; |
| n: | number of data acquired in the interval i; |
| $T_f$: | heating fluid temperature, K; |
| t: | time, s; |
| j | index of summation of capital-sigma notationupdating said cooling/heating rate at least for said defined intervals. |

15. Method according to claim 10, where said control algorithm comprises the following equations:

$$\frac{dL_{frozen}}{dt}=-\frac{1}{\tilde{n}_{II}-\tilde{n}_{Ie}}\frac{M_w}{RT_i}\frac{k_1}{L-L_{frozen}}(p_i(T_i)-p_w) \quad \text{(eq. 12)}$$

$$k_1=\frac{RT_i}{M}\frac{L-L_{frozen}}{R_P} \quad \text{(eq. 13)}$$

$$\left(\frac{1}{K_v}+\frac{L_{frozen}}{k_{frozen}}\right)^{-1}(T_{shelf}-T_i)=\frac{\Delta H_s M_w}{RT_i}\frac{k_1}{L-L_{frozen}}(p_i(T_i)-p_w) \quad \text{(eq. 14)}$$

$$T_B=T_{shelf}-\frac{1}{K_v}\left(\frac{1}{K_v}+\frac{L_{frozen}}{k_{frozen}}\right)^{-1}(T_{shelf}-T_i) \quad \text{(eq. 15)}$$

-continued $T_{SP}(t)$: (eq. 16B)

$$\begin{cases} T_{SP,1} = T_{B,SP} - \left[ 1 - K_v \left( \frac{1}{K_v} + \frac{L_{frozen}(t_0)}{k_{frozen}} \right) (T_{B,SP} - T_i(t_0)) \right]^{-1} & t_0 \le t < t_1 \\ T_{SP,2} = T_{B,SP} - \left[ 1 - K_v \left( \frac{1}{K_v} + \frac{L_{frozen}(t_1)}{k_{frozen}} \right) (T_{B,SP} - T_i(t_1)) \right]^{-1} & t_1 \le t < t_2 \\ \vdots \\ T_{SP,N} = T_{B,SP} - \left[ 1 - K_v \left( \frac{1}{K_v} + \frac{L_{frozen}(t_{N-1})}{k_{frozen}} \right) (T_{B,SP} - T_i(t_{N-1})) \right]^{-1} & t_{N-1} \le t < t_N \end{cases}$$

$$T_{MAX} > \max_{\substack{T_{MAX} > max(T_B(t)) + \Delta T_{DPE} \\ t = t_0 \ldots t_N}} (T_{B,SP}) \quad \text{(eq. 20B)}$$

where the parameters in the equations are:

| | |
|---|---|
| e | error |
| $k_1$ | effective diffusivity coefficient [$m^2 s^{-1}$] |
| $K_v$ | overall heat transfer coefficient [$J m^{-2} s^{-1} K$] |
| L | total product thickness [m] |
| $L_{frozen}$ | frozen layer thickness [m] |
| M | molecular weight [$kmol kg^{-1}$] |
| p | pressure [Pa] |
| R | ideal gas Constant [$J kmol^{-1} K$] |
| $R_p$ | mass transfer resistance in the dried layer [$m^{-1} s$] |
| T | Temperature [K |
| t | time [s] |
| $T_B$ | frozen layer temperature at z = L [K] |
| $T_{MAX}$ | maximum allowable temperature for the product |
| $T_{SP}$ | Set point shelf temperature [K] |
| $\Delta T_{DPE}$ | maximum temperature increase during DPE run |
| ρ | mass density [$kg m^{-3}$] |
| $v_{shelf}$ | cooling or heating rate of the shelf |
| $\Delta H_s$ | enthalpy of sublimation [$J kg^{-1}$] |
| $T_{B,SP}$ | set point value of frozen layer temperature at z = L [K] |
| $\rho_{II}$ | frozen layer mass density [$kg m^{-3}$] |
| $\rho_{Ie}$ | effective dried layer mass density [$kg m^{-3}$] |
| $T_{shelf}$ | temperature of temperature-controlled shelf |

subscripts and superscripts are:

| | |
|---|---|
| I | referred to dried layer |
| II | referred to frozen layer |
| e | effective |
| SP | set point value |
| i | interface |
| ISE | integral square error. |

16. Method according to claim 15, wherein calculating at least said new shelf temperature comprises the following step:

entering said plurality of product/process related parameters and other process/user parameters comprising liquid volume filling each container, number of loaded containers, volume of drying chamber, thermo-physical characteristics of solvent present in product (if different from water), maximum allowable product temperature, control logic selected, horizon and control time;

calculating a relation between $L_{frozen}$ and Ti and a frozen layer temperature by means of equations (eq. 12), (eq. 13), (eq. 14), (eq. 15);

calculating an optimal sequence of set-point temperature values by means of equation (eq. 16A) and equation (eq. 17A) or (eq. 17B) in case of feedback logic, or by means of equation (eq. 16B) in case of feedback logic, and equations (eq. 18), (eq. 19);

calculating an updated product temperature ($T_{B,SP}$) and a new shelf temperature ($T'_{shelf}$) by means of equation (eq. 20A).

17. Method according to claim 6, comprising determining the end of primary drying phase by calculating when a frozen layer of said product is reduced to zero.

18. Method according to claim 17, wherein said determining comprises:

performing a pressure rise test and calculating a current solvent mass flow as the tangent of the pressure rise curve at the beginning of the test;

integrating the solvent mass flow versus time in order to get an actual cumulative sublimated mass curve; the primary drying can be considered finished when the sublimated mass curve reaches a plateau;

calculating a stop coefficient ($\bar{r}_s(i)$) that is directly related to the average sublimating mass rate and it is used as reference for establishing whether or not the main drying is finished, taking into account the similarity between curves in different cycles:

$$\bar{r}_s(i) = \frac{m(i) - m(i-1)}{m_{tot} \cdot (t(i) - t(i-1))} \cdot 100 \quad \text{(eq. 22)}$$

where:

| | |
|---|---|
| m | sublimated solvent mass [kg]; |
| t | time [h]; |
| $r_s$ | sublimating mass rate [$kg s^{-1}$]; |

comparing the current $r_s$ with a limit value set by the user, which consists in the percentage variation of the sublimated solvent mass with respect to the total one, to verify if $r_s$ is lower than this limit and the primary drying can be considered finished.

19. Method according to claim 1, wherein said calculating said new shelf temperature comprises calculating a new shelf temperature according to said product temperature so as to maximize a heat flux provided by said temperature-controlled shelf and so as to drive the product to a desired target temperature (Step 3).

20. Method according to claim 1, comprising before said calculating providing parameters and data related to characteristics of freeze drying process, freeze dryer apparatus, product, containers, number of loaded containers, volume of drying chamber, thermo-physical characteristics of solvent present in product, maximum allowable product temperature during primary drying phase.

21. Method according to claim 1, wherein said collecting pressure values is made at a sampling rate ranging from 5 to 50 Hz.

22. Method comprising performing a primary drying phase of a freeze drying process for freeze-drying a product to be dried in a freeze dryer apparatus provided with a drying chamber having a temperature-controlled shelf supporting containers of a product to be dried, said drying chamber being connected to a condenser chamber, said method comprising during said primary drying phase the steps of:

entering a plurality of process/product related parameters comprising liquid volume filling each container, number of loaded containers, volume of drying chamber, thermo-physical characteristics of solvent present in product (if different from water), maximum allowable product temperature, control logic selected, horizon and control time;

calculating at least a product temperature and a new shelf temperature and/or a sequence of shelf temperatures up to the end of the primary drying phase that maximises a sublimation rate of said product maintaining the product temperature below said maximum allowable product temperature; and adjusting a temperature of said temperature-controlled shelf on the basis of said new shelf temperature for minimising the duration of drying phase and preserving the product quality;

wherein said calculating is made by means of a control algorithm, based on a numerical code, which implements a non stationary mathematical model of containers and of freeze dryer apparatus and an optimization algorithm which uses as inputs said product/process related parameters, and further wherein said control algorithm comprises a PID type controller for controlling a product temperature and for minimizing an energy consumption during said primary drying phase, said control algorithm comprising the following equations:

$$\frac{dL_{frozen}}{dt} = -\frac{1}{\tilde{n}_{II} - \tilde{n}_{Ie}} \frac{M_w}{RT_i} \frac{k_1}{L - L_{frozen}} (p_i(T_i) - p_w) \quad \text{(eq. 12)}$$

$$k_1 = \frac{RT_i}{M} \frac{L - L_{frozen}}{R_P} \quad \text{(eq. 13)}$$

$$\left(\frac{1}{K_v} + \frac{L_{frozen}}{k_{frozen}}\right)^{-1} (T_{shelf} - T_i) = \frac{\Delta H_s M_w}{RT_i} \frac{k_1}{L - L_{frozen}} (p_i(T_i) - p_w) \quad \text{(eq. 14)}$$

$$T_B = T_{shelf} - \frac{1}{K_v}\left(\frac{1}{K_v} + \frac{L_{frozen}}{k_{frozen}}\right)^{-1} (T_{shelf} - T_i) \quad \text{(eq. 15)}$$

$$T_{SP}(t): \quad \text{(eq. 16A)}$$

$$\begin{cases} T_{SP,1} = T_{shelf}(t_0) + K_{OPT}(T_B(t_0) - T_{B,SP}) & t_0 \le t < t_1 \\ T_{SP,2} = T_{shelf}(t_1) + K_{OPT}(T_B(t_1) - T_{B,SP}) & t_1 \le t < t_2 \\ \vdots \\ T_{SP,N} = T_{shelf}(t_{N-1}) + K_{OPT}(T_B(t_{N-1}) - T_{B,SP}) & t_{N-1} \le t < t_N \end{cases}$$

$$\min_{K_{OPT}} (ISE) = \min_{K_{OPT}} \int_{t_0}^{t_N} (T_B(t) - T_{B,SP})^2 \, dt \quad \text{(eq. 17A)}$$

$$F = \int_{t_0}^{t_h} \frac{1}{t} \cdot e^2(t) \cdot dt \quad \text{(eq. 17B)}$$

or $$T_{MAX} > \max_{\substack{T_{MAX} > max(T_B(t)) + \Delta T_{DPE} \\ t = t_0 \ldots t_N}} (T_{B,SP}) \quad \text{(eq. 20B)}$$

where the parameters in the equations are:

| | |
|---|---|
| e | error |
| $k_1$ | effective diffusivity coefficient [$m^2 s^{-1}$] |
| $K_{OPT}$ | optimum gain of the controller |
| $K_v$ | overall heat transfer coefficient [$J m^{-2} s^{-1} K$] |
| $k_{frozen}$ | frozen layer thermal conductivity [$J m s^{-1} K$] |
| L | total product thickness [m] |

-continued

| | |
|---|---|
| $L_{frozen}$ | frozen layer thickness [m] |
| M | molecular weight [$kmol kg^{-1}$] |
| $M_w$ | water vapour molecular weight [kmol kg−1] |
| p | pressure [Pa] |
| $p_w$ | water vapour pressure [Pa] |
| R | ideal gas Constant [$J kmol^{-1} K$] |
| $R_p$ | mass transfer resistance in the dried layer [$m^{-1} s$] |
| T | Temperature [K |
| t | time [s] |
| $T_B$ | frozen layer temperature at z = L [K] |
| $T_{MAX}$ | maximum allowable temperature for the product |
| $\Delta T_{DPE}$ | maximum temperature increase during DPE run |
| ρ | mass density [$kg m^{-3}$] |
| $\nu_{shelf}$ | cooling or heating rate of the shelf |
| $\Delta H_s$ | enthalpy of sublimation [$J kg^{-1}$] |
| $\rho_{II}$ | frozen layer mass density [$kg m^{-3}$] |
| $\rho_{Ie}$ | effective dried layer mass density [$kg m^{-3}$] |
| $T_{SP}$ | Set point shelf temperature [K] |
| $T_{B,SP}$ | set point value of frozen layer temperature at z = L [K] |
| $T_{shelf}$ | temperature of temperature-controlled shelf |

subscripts and superscripts are:

| | |
|---|---|
| I | referred to dried layer |
| II | referred to frozen layer |
| e | effective |
| SP | set point value |
| i | interface |
| ISE | integral square error |

where the parameters in equation (eq. 17B) are:

| | |
|---|---|
| e | difference between the bottom product temperature and its limit [K]; |
| F | cost function; |
| t | time [s]; |
| $t_0$ | initial time [s]; |
| $t_h$ | horizon time [s] |

or comprising the following equations:

$$\frac{dL_{frozen}}{dt} = -\frac{1}{\tilde{n}_{II} - \tilde{n}_{Ie}} \frac{M_w}{RT_i} \frac{k_1}{L - L_{frozen}} (p_i(T_i) - p_w) \quad \text{(eq. 12)}$$

$$k_1 = \frac{RT_i}{M} \frac{L - L_{frozen}}{R_P} \quad \text{(eq. 13)}$$

$$\left(\frac{1}{K_v} + \frac{L_{frozen}}{k_{frozen}}\right)^{-1} (T_{shelf} - T_i) = \frac{\Delta H_s M_w}{RT_i} \frac{k_1}{L - L_{frozen}} (p_i(T_i) - p_w) \quad \text{(eq. 14)}$$

$$T_B = T_{shelf} - \frac{1}{K_v}\left(\frac{1}{K_v} + \frac{L_{frozen}}{k_{frozen}}\right)^{-1} (T_{shelf} - T_i) \quad \text{(eq. 15)}$$

-continued $T_{SP}(t)$: (eq. 16B)

$$\begin{cases} T_{SP,1} = T_{B,SP} - \left[ 1 - K_v \left( \frac{1}{K_v} + \frac{L_{frozen}(t_0)}{k_{frozen}} \right) (T_{B,SP} - T_i(t_0)) \right]^{-1} & t_0 \le t < t_1 \\ T_{SP,2} = T_{B,SP} - \left[ 1 - K_v \left( \frac{1}{K_v} + \frac{L_{frozen}(t_1)}{k_{frozen}} \right) (T_{B,SP} - T_i(t_1)) \right]^{-1} & t_1 \le t < t_2 \\ \vdots \\ T_{SP,N} = T_{B,SP} - \left[ 1 - K_v \left( \frac{1}{K_v} + \frac{L_{frozen}(t_{N-1})}{k_{frozen}} \right) (T_{B,SP} - T_i(t_{N-1})) \right]^{-1} & t_{N-1} \le t < t_N \end{cases}$$

$$T_{MAX} > \max_{\substack{T_{MAX} > max(T_B(t)) + \Delta T_{DPE} \\ t = t_0 \ldots t_N}} (T_{B,SP}) \quad \text{(eq. 20B)}$$

where the parameters in the equations are:

| | |
|---|---|
| e | error |
| $k_1$ | effective diffusivity coefficient [m2 $s^{-1}$] |
| $K_v$ | overall heat transfer coefficient [J $m^{-2}$ $s^{-1}$ K] |
| $k_{frozen}$ | frozen layer thermal conductivity [J m $s^{-1}$ K] |
| L | total product thickness [m] |
| $L_{frozen}$ | frozen layer thickness [m] |
| M | molecular weight [kmol $kg^{-1}$] |
| $M_w$ | water vapour molecular weight [kmol $kg^{-1}$] |
| p | pressure [Pa] |
| $p_w$ | water vapour pressure [Pa] |
| R | ideal gas Constant [J $kmol^{-1}$ K] |
| $R_p$ | mass transfer resistance in the dried layer [$m^{-1}$ s] |
| T | Temperature [K] |
| t | time [s] |
| $T_B$ | frozen layer temperature at z = L [K] |
| $T_{MAX}$ | maximum allowable temperature for the product |
| $\Delta T_{DPE}$ | maximum temperature increase during DPE run |
| ρ | mass density [kg $m^{-3}$] |
| $v_{shelf}$ | cooling or heating rate of the shelf |
| $\Delta H_s$ | enthalpy of sublimation [J $kg^{-1}$] |
| $\rho_{II}$ | frozen layer mass density [kg $m^{-3}$] |
| $\rho_{Ie}$ | effective dried layer mass density [kg $m^{-3}$] |
| $T_{SP}$ | Set point shelf temperature [K] |
| $T_{B,SP}$ | set point value of frozen layer temperature at z = L [K] |
| $T_{shelf}$ | temperature of temperature-controlled shelf |

subscripts and superscripts are:

| | |
|---|---|
| I | referred to dried layer |
| II | referred to frozen layer |
| e | effective |

-continued

| | |
|---|---|
| SP | set point value |
| i | interface |
| ISE | integral square error. |

23. Method according to claim 22, wherein said calculating comprises calculating a new shelf temperature according to said product temperature so as to maximize a heat flux provided by said temperature-controlled shelf and so as to drive the product to a desired target temperature.

24. Method according to claim 22, wherein calculating at least said new shelf temperature comprises the following step:

entering said plurality of product/process related parameters and other process/user parameters;

calculating a relation between $L_{frozen}$ and Ti and a frozen layer temperature by means of equations (eq. 12), (eq. 13), (eq. 14), (eq. 15);

calculating an optimal sequence of set-point temperature values by means of equation (eq. 16A) in case of feedback logic, or by means of equation (eq. 16B) in case of feedback logic, equation (eq. 17A) or (eq. 17b) and equations (eq. 18), (eq. 19);

calculating an updated product temperature and a new shelf temperature by means of equation (eq. 20B).

25. Method according to claim 24, further comprising the following steps for calculating cooling/heating rates during a cooling/heating step of said primary drying phase:

defining a defined number of temperature intervals where said cooling/heating rates will be calculated;

during said cooling/heating step collecting the shelf temperature throughout all temperature intervals;

calculating the cooling/heating rate for each interval by means of equation:

$$r_i = \frac{1}{n} \sum_{j=2}^{n} \left( \frac{(T_f(j) - T_f(j-1))}{(t(j) - t(j-1))} \right) \quad \text{(eq. 21)}$$

where:

| | |
|---|---|
| $r_i$: | cooling/heating rate for the temperature interval i, K/min; |
| n: | number of data acquired in the interval i; |
| $T_f$: | heating fluid temperature, K; |
| t: | time, s; |

updating said cooling/heating rate at least for said defined intervals.

26. Method according to claim 22, wherein said plurality of product/process related parameters can be received from an estimator tool and/or from a sensor.

* * * * *